US010856602B2

(12) United States Patent
Kikukawa

(10) Patent No.: US 10,856,602 B2
(45) Date of Patent: Dec. 8, 2020

(54) FOOTWEAR, SOUND OUTPUT SYSTEM, AND SOUND OUTPUT METHOD

(71) Applicant: NO NEW FOLK STUDIO INC., Tokyo (JP)

(72) Inventor: Yuya Kikukawa, Tokyo (JP)

(73) Assignee: NO NEW FOLK STUDIO INC., Tokyo (JP)

( * ) Notice: Subject to any disclaimer, the term of this patent is extended or adjusted under 35 U.S.C. 154(b) by 122 days.

(21) Appl. No.: 15/106,828

(22) PCT Filed: Feb. 18, 2016

(86) PCT No.: PCT/JP2016/054692
§ 371 (c)(1),
(2) Date: Mar. 21, 2018

(87) PCT Pub. No.: WO2016/133158
PCT Pub. Date: Aug. 25, 2016

(65) Prior Publication Data

US 2018/0199657 A1 Jul. 19, 2018

(30) Foreign Application Priority Data

Feb. 18, 2015 (JP) ..... 2015-029573

(51) Int. Cl.
*A43B 13/12* (2006.01)
*A43B 3/00* (2006.01)
(Continued)

(52) U.S. Cl.
CPC ..... *A43B 3/0021* (2013.01); *A43B 1/0027* (2013.01); *A43B 3/001* (2013.01);
(Continued)

(58) Field of Classification Search
CPC . G06F 19/00; A43B 3/01; A43B 3/203; H02J 7/25
(Continued)

(56) References Cited

U.S. PATENT DOCUMENTS 2,572,760 A * 10/1951 Rikelman ..... A43B 1/0036 362/103
5,303,485 A 4/1994 Goldston et al.
(Continued)

FOREIGN PATENT DOCUMENTS

CN 1143328 A 2/1997
CN 103442607 A 12/2013
(Continued)

OTHER PUBLICATIONS

PCT International Search Report for application PCT/JP2016/054692 dated Jun. 14, 2016.
(Continued)

*Primary Examiner* — Titus Wong
(74) *Attorney, Agent, or Firm* — Alston & Bird LLP

(57) ABSTRACT

Adaptive output control is performed on the basis of sound and motion.
Footwear includes a sensor portion that detects motion of the footwear, a transmission portion that transmits sensor data detected by the sensor portion to an external apparatus, a reception portion that receives an output control signal based on sound data and the sensor data from the external apparatus, and an output portion that performs output based on the output control signal.

1 Claim, 18 Drawing Sheets

(51) Int. Cl.
*A43B 1/00* (2006.01)
*A43B 3/24* (2006.01)
*A43B 5/12* (2006.01)
*A43B 13/26* (2006.01)
*A43B 23/24* (2006.01)

(52) U.S. Cl.
CPC ..... *A43B 3/0078* (2013.01); *A43B 3/242* (2013.01); *A43B 5/12* (2013.01); *A43B 13/26* (2013.01); *A43B 23/24* (2013.01)

(58) Field of Classification Search
USPC ..... 710/7
See application file for complete search history.

(56) References Cited

U.S. PATENT DOCUMENTS 5,461,188 A * 10/1995 Drago ..... A43B 3/0005 84/600
5,546,681 A * 8/1996 Goldston ..... A43B 1/0036 36/137
5,615,111 A * 3/1997 Raskas ..... A43B 3/00 36/136
5,732,486 A * 3/1998 Rapisarda ..... A43B 1/0036 36/136
5,799,418 A * 9/1998 Davis ..... A43B 5/18 36/116
6,278,378 B1 * 8/2001 Feiner ..... A43B 1/0036 340/573.1
7,494,237 B1 * 2/2009 Cheung ..... A43B 3/0005 315/76
2006/0104047 A1 * 5/2006 Guzman ..... A43B 1/0036 362/103
2006/0265187 A1 * 11/2006 Vock ..... A42B 3/0433 702/182
2007/0041193 A1 * 2/2007 Wong ..... A43B 3/0005 362/276
2007/0079690 A1 4/2007 Chiwata
2007/0180737 A1 * 8/2007 DiBenedetto ..... A43B 1/0009 36/132
2008/0203144 A1 * 8/2008 Kim ..... A61B 5/00 235/105
2011/0023331 A1 * 2/2011 Kolodjski ..... A43B 3/0021 36/139
2011/0040879 A1 * 2/2011 Konig ..... A43B 1/0036 709/227
2011/0175744 A1 * 7/2011 Englert ..... A43B 1/0054 340/665
2011/0308113 A1 12/2011 Hartford et al.
2012/0297960 A1 * 11/2012 Bader ..... G10H 1/0033 84/644
2013/0093588 A1 * 4/2013 Bender ..... G09B 19/0038 340/539.11
2013/0242703 A1 * 9/2013 Zlotnick ..... H04B 13/02 367/135
2014/0139353 A1 * 5/2014 Wojcieszak ..... A43B 3/001 340/870.16
2014/0180460 A1 * 6/2014 Seiler ..... A61H 23/0236 700/94
2016/0093199 A1 * 3/2016 Whitney ..... A43B 3/0005 340/539.13

FOREIGN PATENT DOCUMENTS

JP 7-504602 A 5/1995
JP 2001242813 A 9/2001
JP 2002-035191 A 2/2002
JP 2006-267711 A 5/2006
JP 2007-090076 A 4/2007
JP 3151948 U 7/2009
JP 2013-0370136 A 2/2013
JP 2013-529504 A 7/2013
JP 3192015 U 7/2014
JP 3193890 U 10/2014
WO WO 1995/024250 A1 9/1995
WO WO 2012/109244 A1 8/2012

OTHER PUBLICATIONS

PCT Written Opinion of the International Searching Authority for application PCT/JP2016/054692 dated Jun. 14, 2016.
Japanese Application No. 2016-510864, Office Action dated Jun. 7, 2016.
Chinese Application No. 201680000481.3, Office Action dated Sep. 3, 2019.
Chinese Application No. 201680000481.3, Office Action dated Apr. 26, 2020.

* cited by examiner (B)

FIG. 17

(a)

1700

| 1701 GESTURE DATA | 1702 SOUND FILE |
|---|---|
| ⋮ | ⋮ |
| GESTURE PATTERN 1 | SOUND FILE 1 |
| GESTURE PATTERN 2 | SOUND FILE 2 |
| GESTURE PATTERN 3 | SOUND FILE 3 |
| ⋮ | ⋮ |

(b)

1710

| 1711 MOVEMENT AMOUNT DATA | 1712 SOUND PARAMETER |
|---|---|
| ⋮ | ⋮ |
| MOVEMENT PATTERN 1 | PARAMETER 1 |
| MOVEMENT PATTERN 2 | PARAMETER 2 |
| MOVEMENT PATTERN 3 | PARAMETER 3 |
| ⋮ | ⋮ |

FOOTWEAR, SOUND OUTPUT SYSTEM, AND SOUND OUTPUT METHOD

CROSS-REFERENCE TO RELATED APPLICATIONS

This is a national stage application filed under 35 U.S.C. 371 based on International Patent Application No. PCT/JP2016/054692, filed Feb. 18, 2016 and entitled "FOOTWEAR, SOUND OUTPUT SYSTEM, AND SOUND OUTPUT METHOD", the content of which is incorporated herein by reference in its entirety.

TECHNICAL FIELD

The present invention relates to footwear and an output control method.

BACKGROUND ART

In the related art, there is footwear which includes a color changing portion, measures a performance parameter, and colors the color changing portion according to the measured performance parameter (for example, refer to PTL 1).

SUMMARY OF INVENTION

Technical Problem

However, in the footwear of the related art, the color changing portion just changes colors on the basis of a performance parameter measured in the footwear, and does not change colors according to a signal received from the outside. In other words, the footwear of the related art does not adaptively change colors according to a plurality of parameters.

Here, in the footwear, if output control can be performed according to not only a measured parameter but also a signal from the outside, when a dancer dances to music or the like, the footwear can be made attractive to the dancer by interactively interlocking sound, motion, and light with each other.

Therefore, an object of the present invention is to provide footwear and an output control method capable of adaptively performing output control on the basis of sound and motion.

Solution to Problem

According to an aspect of the present invention, there is provided footwear including a sensor portion that detects motion of the footwear; a transmission portion that transmits sensor data detected by the sensor portion to an external apparatus; a reception portion that receives an output control signal based on sound data and the sensor data from the external apparatus; and an output portion that performs output based on the output control signal.

Advantageous Effects of Invention

According to the present invention, it is possible to adaptively perform output control on the basis of sound and motion.

BRIEF DESCRIPTION OF DRAWINGS

FIGS. 17A and 17B are conceptual diagrams of audio information data for performing sound output control of the footwear related to Example.

DESCRIPTION OF EMBODIMENTS

Figure 1:
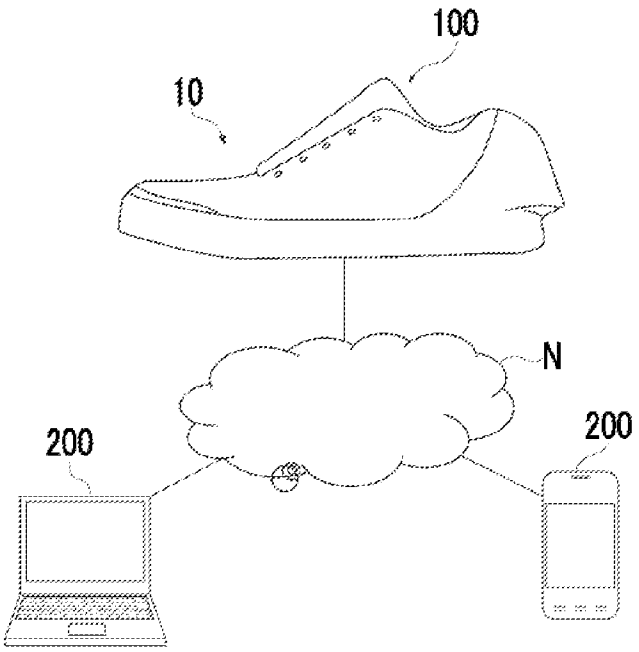
FIG. 1 is a diagram illustrating an example of a configuration of an output control system in an embodiment.

Hereinafter, with reference to the drawings, embodiments of the present invention will be described. However, the embodiments described below are only examples, and it is not intended to exclude application of various modifications or techniques which are not clearly shown in the following description. In other words, the present invention may be variously modified within the scope without departing from the spirit thereof. In the following description of the drawings, identical or similar portions are given identical or similar reference numerals. The drawings are schematic, and do not necessarily match actual dimensions or proportions. The drawings may also include a portion having dimensional relationships or proportions which are different from each other.

Embodiment 1

Hereinafter, with reference to the drawings, a description will be made of footwear and an output control method according to embodiments of the present invention.

<Summary of Output Control System>

FIG. 1 is a diagram illustrating an example of a configuration of an output control system 10 in an embodiment. In the example illustrated in FIG. 1, in the output control system 10, footwear 100 and an information processing apparatus 200 are connected to each other via a network N. A plurality of pieces of footwear 100 may be connected to the network N. The information processing apparatus 200 may be any apparatus as long as the apparatus such as a personal computer (PC) or a portable terminal can process a signal acquired via the network N. A server may be connected to the network N.

The output control system 10 illustrated in FIG. 1 performs output control on an output portion provided in the footwear 100 by using an output control signal based on sensor data sensed by a sensor provided in the footwear 100 and sound data stored in the information processing apparatus 200.

For example, in a case where a light emitting diode (LED) is used as the output portion, the output control system 10 controls light emission control on the LED interlocking with motion of the footwear 100 and music. As a more specific example, if a dancer wearing the footwear 100 moves the feet thereof in accordance with music, light emission control on the LED is performed in accordance with the motion of the feet and the music, and thus the motion, the sound, and the light appear integrally interlocked with each other to an audience.

<Hardware Configuration>

Figure 2:
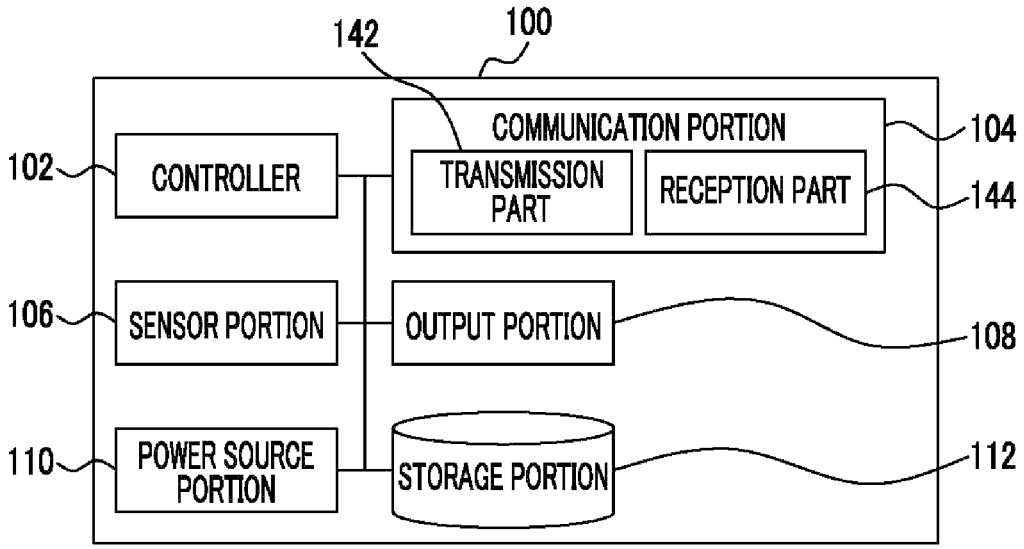
FIG. 2 is a diagram illustrating an example of a schematic configuration of hardware of footwear in the embodiment.

Next, a description will be made of a summary of hardware of each apparatus in the output control system 10. FIG. 2 is a diagram illustrating an example of a schematic configuration of hardware of the footwear 100 in the embodiment. The footwear 100 illustrated in FIG. 2 includes at least a controller 102, a communication portion 104, a sensor portion 106, an output portion 108, a power source portion 110, and a storage portion 112. The communication portion 104 includes a transmission part 142 and a reception part 144. An upper portion or a sole portion of the footwear 100 is not illustrated.

The controller 102 is, for example, a central processing unit (CPU), and executes a program developed on a memory so as to cause the footwear 100 to realize various functions. The controller 102 performs various calculations on the basis of sensor data sensed by the sensor portion 106 or an output control signal received by the reception part 144. For example, if the output control signal is acquired, the controller 102 controls output of the output portion 108 in response to the output control signal. Details of the controller 102 will be described with reference to FIG. 4.

The communication portion 104 performs transmission and reception of data via the communication network N. For example, the transmission part 142 transmits sensor data detected by the sensor portion 106 to the information processing apparatus 200. For example, the reception part 144 receives an output control signal based on sensor data and sound data from a single information processing apparatus 200. The communication portion 104 may set a combination between apparatuses 200 and pieces of footwear 100 as communication partners before transmission and reception of data. The communication is not necessarily performed in a one-to-one relationship, and, for example, a single information processing apparatus 200 may transmit data to a plurality of pieces of footwear 100.

The communication network N is constituted of a wireless network or a wired network. Examples of the communication network include networks based on a mobile phone network, a personal handy-phone system (PHS) network, a wireless local area network (LAN), 3rd Generation (3G), Long Term Evolution (LTE), 4th Generation (4G), WiMax (registered trademark), infrared communication, Bluetooth (registered trademark), a wired LAN, a telephone line, a lamp line network, IEEE 1394, and ZigBee (registered trademark).

The sensor portion 106 includes an acceleration sensor and an angular velocity (gyro) sensor, and may further include a geomagnetism sensor. For example, the sensor portion 106 includes a nine-axis sensor into which a three-axis acceleration sensor, a three-axis angular velocity sensor, and a three-axis geomagnetism sensor are integrated.

The sensor portion 106 detects motion of the footwear 100. For example, in a case where a user wears the footwear 100, motion of the foot is detected. Sensor data detected by the sensor portion 106 is transmitted to the external information processing apparatus 200 via the transmission part 142.

The output portion 108 performs output under the control of the controller 102 based on an output control signal. The output portion 108 includes, for example, a light emitting part whose light emission is controlled by the controller 102 and which emits light. The light emitting part is, for example, an LED. A plurality of LEDs may be provided, and, RGB 8-bit full colors may be individually controlled. A plurality of LEDs may be linearly provided over a side surface of the sole portion, or a plurality of LEDs may be linearly provided on a heel portion.

The output portion 108 may include a curved display such as an organic electroluminescent (EL) element, a speaker, and the like, and may realize output based on an output control signal by using images or sound. The output portion 108 may include a vibration element or the like, and may realize output based on an output control signal by using vibration.

The power source portion 110 is, for example, a battery, and supplies power to each portion of the footwear 100.

The storage portion 112 stores, for example, a program or various data. The program is executed by the controller 102. The various data include, for example, image information, information regarding an output function of the output portion, calibration information regarding the sensor portion 106, and the like.

In the footwear 100, the above-described constituent elements may be provided on the sole portion, only the output portion 108 may be provided on the upper portion, or the output portion 108 may be provided on both of the sole portion and the upper portion.

Figure 3:
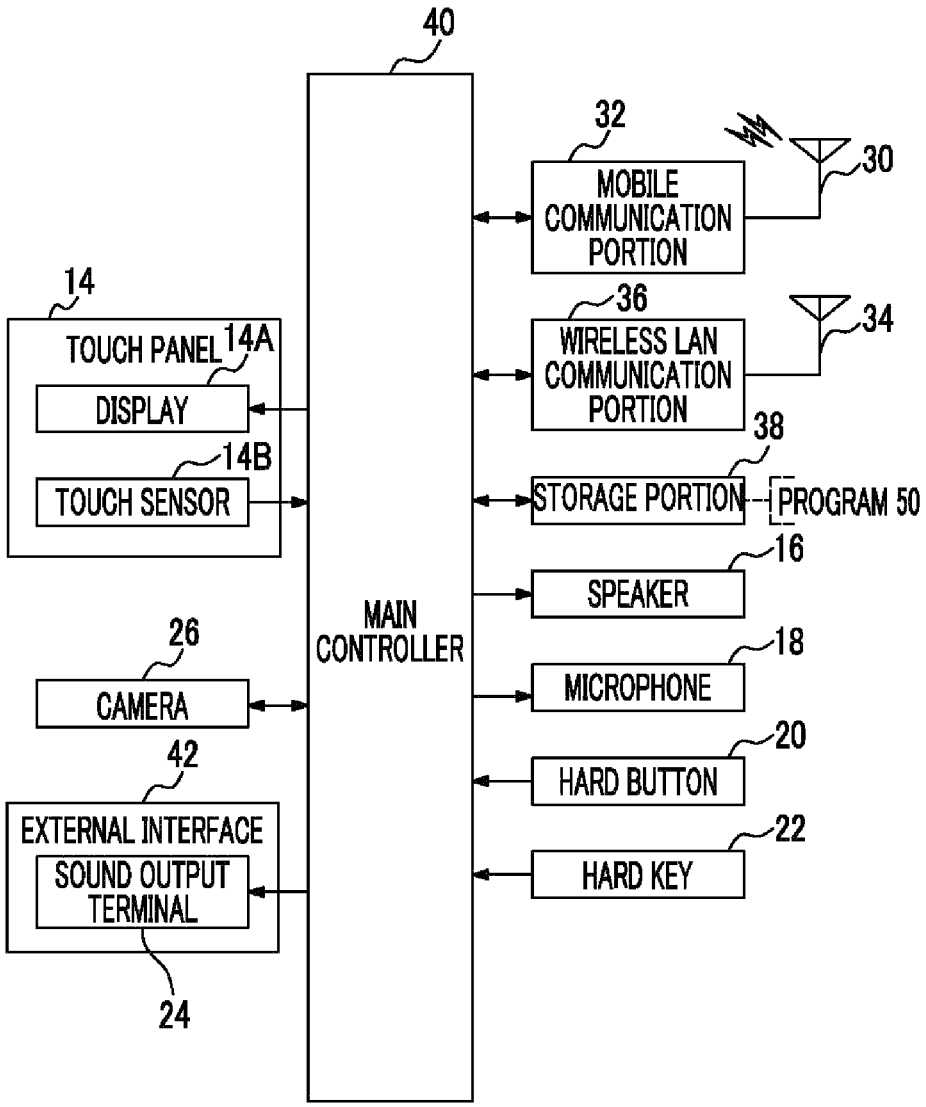
FIG. 3 is a diagram illustrating an example of a hardware configuration of an information processing apparatus in the embodiment.

Next, a description will be made of a summary of hardware of the information processing apparatus 200. FIG. 3 is a diagram illustrating an example of a hardware configuration of the information processing apparatus 200 in the embodiment. The information processing apparatus 200 illustrated in FIG. 3 includes a touch panel 14, a speaker 16, a microphone 18, a hard button 20, a hard key 22, a mobile communication antenna 30, a mobile communication portion 32, a wireless LAN communication antenna 34, a wireless LAN communication portion 36, a storage portion 38, a main controller 40, a camera 26, an external interface 42 provided with a sound output terminal 24, and the like. The camera 26 or the like may not necessarily be provided.

The touch panel 14 has both functions of a display device and an input device, and is constituted of a display (display screen) 14A having a display function, and a touch sensor 14B having an input function. The display 14A is constituted of a general display device such as a liquid crystal display or an organic EL display. The touch sensor 14B includes an element which is disposed on the display 14A and detects a contact operation, and a transparent operation surface stacked thereon. A touch detection method of the touch sensor 14B may employ any method among existing methods such as a capacitance type, a resistive film type (pressure sensitive type), and an electromagnetic induction type.

The touch panel 14 displays an image which is generated by the main controller 40 executing a program 50 stored in the storage portion 38. The touch panel 14 as an input device detects an action of a contact object (which includes a user's finger, a touch pen, or the like; hereinafter, the "finger" will be described as a representative example) which comes into contact with the operation surface so as to receive an input operation, and sends information regarding a contact position to the main controller 40. An action of the finger is detected as coordinate information indicating a position or a region of a contact point, and the coordinate information is represented by, for example, coordinate values on two axes in a short side direction and a long side direction of the touch panel 14.

The information processing apparatus 200 is connected to the network (Internet) N via the mobile communication antenna 30 or the wireless LAN communication antenna 34, and can perform data communication with the footwear 100 or a server.

The program 50 related to the embodiment may be installed in the information processing apparatus 200, and may be provided with an output control function from a server online. The program 50 is executed, and thus an application for controlling output of the footwear 100 is operated.

<Functional Configuration>

Next, a functional configuration of each of the footwear 100 and the information processing apparatus 200 will be described. First, a functional configuration of the footwear 100 will be described.

Figure 4:
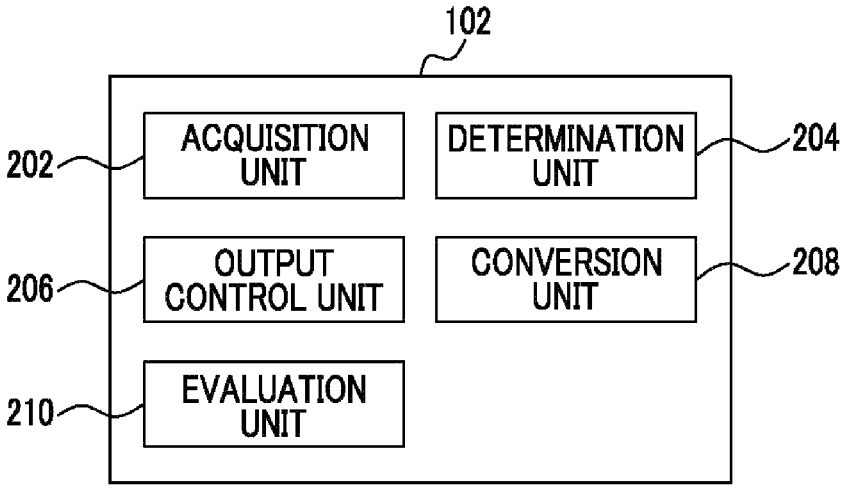
FIG. 4 is a diagram illustrating an example of a function of a controller of the footwear in the embodiment.

FIG. 4 is a diagram illustrating an example of a function of the controller 102 of the footwear 100 in the embodiment. The controller 102 illustrated in FIG. 4 executes a predetermined program and thus functions as at least an acquisition unit 202, a determination unit 204, an output control unit 206, a conversion unit 208, and an evaluation unit 210.

The acquisition unit 202 acquires detected sensor data from the sensor portion 106. For example, the sensor data is a signal indicating motion of the footwear 100. The acquired sensor data is output to the transmission part 142 or the determination unit 204.

The acquisition unit 202 acquires an output control signal received by the reception part 144. The output control signal is a control signal corresponding to the output content of the output portion 108, and is at least one of, for example, a light emission control signal, a display control signal, a sound control signal, and a vibration control signal. The acquired output control signal is output to the output control unit 206.

The determination unit 204 determines whether or not the footwear 100 is moved in a predetermined direction on the basis of the sensor data. For example, the determination unit 204 can recognize a posture and a movement direction of the footwear 100 on the basis of the sensor data, and thus determines motion of the footwear in a direction which is substantially perpendicular to the linear direction in which the LEDs are provided. The predetermined direction may be set as appropriate according to the output content of the output portion 108.

The output control unit 206 controls output of the output portion 108 on the basis of the output control signal. For example, the output control unit 206 controls a light emission position, a light color, light intensity, and the like in a case where the output portion 108 is a plurality of LEDs.

In a case where a predetermined image is output by the output portion 108, the conversion unit 208 converts the predetermined image into data indicating a position or a color of the LED corresponding to the predetermined image so as to generate a light emission control signal (output control signal). The conversion unit 208 outputs the light emission control signal to the output control unit 206. The conversion unit 208 may be installed as a function of the output control unit 206.

The output control unit 206 may control light emission of a plurality of light emitting parts so that an afterimage of light representing a predetermined image appears in a predetermined direction on the basis of a light emission control signal generated by the conversion unit 208. Consequently, it is possible to increase output expression from the footwear 100.

The evaluation unit 210 evaluates motion of the footwear 100 based on the sensor data. For example, the evaluation unit 210 holds data obtained by sensing sample motion as time series model data. The model data may be received from the information processing apparatus 200 or the server, and sensor data obtained by sensing sample motion may be held as data obtained through learning such as machine learning.

The evaluation unit 210 compares the model data and the sensor data with each other, outputs a good evaluation result if both of the data are similar to each other, and outputs a bad evaluation result if both of the data are not similar to each other. Regarding determination of similarity, for example, the evaluation unit 210 determines that both of the data are similar to each other if a cumulative difference value of both of the data is equal to or smaller than a predetermined value, and determines that both of the data are not similar to each other if the cumulative difference value of both of the data is greater than the predetermined value. An evaluation result may be output by performing evaluation in a plurality of stages according to the magnitude of a cumulative difference value.

The output control unit 206 may control output of the output portion 108 on the basis of the evaluation result in the evaluation unit 210. For example, the output control unit 206 controls output of the output portion 108, such as outputting red light in a case of a good evaluation result and outputting green light in a case of a bad evaluation result. This may be applied, for example, in a case where evaluation is performed when a dancer practices foot steps.

Figure 5:
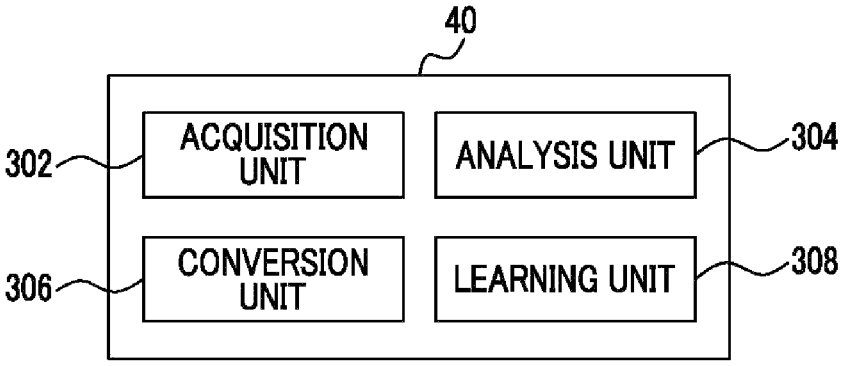
FIG. 5 is a diagram illustrating an example of a function of a main controller of the information processing apparatus in the embodiment.

Next, a description will be made of a function of the information processing apparatus 200. FIG. 5 is a diagram illustrating an example of a function of the main controller 40 of the information processing apparatus 200 in the embodiment. The main controller 40 illustrated in FIG. 5 executes the program 50 and thus functions as at least an acquisition unit 302, an analysis unit 304, a conversion unit 306, and a learning unit 308.

The acquisition unit 302 acquires sensor data received by the wireless LAN communication portion 36 or the like. The sensor data is sensor data detected by the sensor portion 106 provided in the footwear 100. The acquired sensor data is output to the conversion unit 306.

The analysis unit 304 analyzes sound by using a general acoustic analysis technique. The analysis unit 304 analyzes, for example, percussive sound in music, sound pressure, a pitch, chord constitution, and the like. Data regarding an analysis result is output to the conversion unit 306.

The conversion unit 306 converts the sensor data and the analysis result data (also referred to as sound data) into an output control signal for controlling the output portion 108 of the footwear 100. The conversion unit 306 generates an output control signal so that, for example, a first color is displayed when sound is equal to or higher than a first pitch, and a second color is displayed when the sound is lower than the first pitch, on the basis of the analysis result data, and a third color is displayed when predetermined motion is detected on the basis of the sensor data.

The conversion unit 306 may change a ratio in which each of the sound data and the sensor data contributes to the output control signal on the basis of a previous setting. For example, if the influence of acoustic analysis is to be increased, the conversion unit 306 may set a contribution ratio of the sound data to 80%, and a contribution ratio of the sensor data to 20%. A contribution ratio may be set in advance by a user.

The conversion unit 306 may select parameters (for example, a pitch, percussive sound, sound pressure, and chord constitution) of the sound data as a light emission control target, and may select parameters (for example, the type of motion, a movement direction, and a movement speed) of the sensor data as a light emission control target. The conversion unit 306 may select light emission parameters (for example, an emission color, emitted light intensity, and a light emission position).

The conversion unit 306 associates a selected light emission control target parameter with a light emission parameter. Consequently, as described above, the conversion unit 306 can generate an output control signal so that the first color is displayed when sound is equal to or higher than a first pitch, the second color is displayed when the sound is lower than the first pitch, and the third color is displayed when predetermined motion of the footwear 100 is detected.

The learning unit 308 accumulates the sensor data acquired from the footwear 100, extracts a feature amount from the sensor data, and performs machine learning of the extracted feature amount. A feature amount extracting process and a machine learning process may employ well-known techniques. For example, the learning unit 308 acquires model data used as a dance step model by performing machine learning of sensor data of the footwear 100. The model data may be acquired through downloading from the server or the like.

Example

Figure 6:
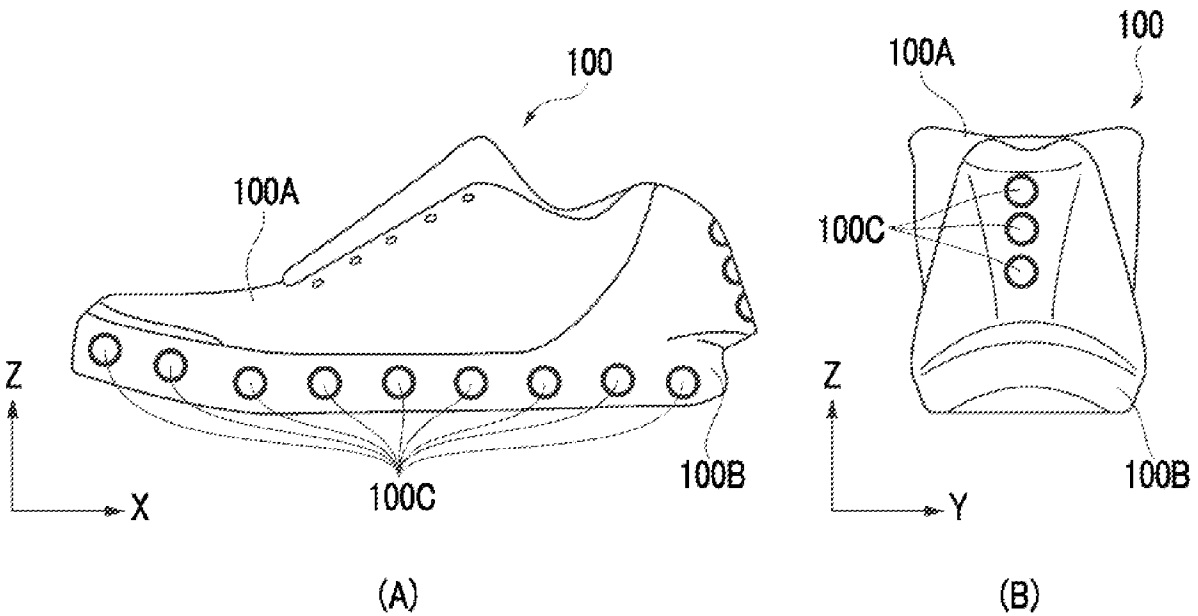
FIGS. 6A and 6B are diagrams illustrating an example of footwear in Example.

Next, a description will be made of Example in which a plurality of LEDs are provided in the sole portion of the above-described footwear 100 as the output portion 108. FIGS. 6A and 6B are diagrams illustrating an example of the footwear 100 in Example. FIG. 6A is a side view illustrating an example of the footwear 100 in Example. FIG. 6B is a rear view illustrating an example of the footwear 100 in Example.

In the example illustrated in FIGS. 6A and 6B, the footwear 100 is constituted of an upper portion 100A and a sole portion 100B, and a plurality of LEDs 100C are provided on the sole portion 100B. The LEDs 100C are provided on a side surface of the sole portion 100B in the X direction. The LEDs 100C may also be provided on a heel part of the upper portion 100A in the Z direction. A position where the LEDs 100C are disposed is only an example, and is not limited to the example illustrated in FIGS. 6A and 6B.

<Light Emission Control (First)>

In the footwear 100 illustrated in FIGS. 6A and 6B, a description will be made of light emission control (first), for example, in a case where a dancer wears the footwear and dances. If the dancer dances to music, sensor data indicating motion of the footwear 100 is transmitted to the information processing apparatus 200. The information processing apparatus 200 generates a light emission control signal on the basis of a result of performing acoustic analysis on a sound source of the music and the acquired sensor data.

For example, the information processing apparatus 200 generates a basic control signal on the basis of the acoustic analysis result, and additionally inserts a light emission control signal thereinto when it is determined that the sensor data is motion indicating light emission control. Consequently, it is possible to adaptively perform light emission control on the basis of sound and motion.

By performing the above-described output control, for example, the LEDs 100C of the footwear 100 can emit light in accordance with percussive sound or the like of the music, emission colors can be changed depending on a pitch difference, and the LEDs 100C can emit light with a predetermined color according to a tap operation. Therefore, control is performed so that the motion, the sound, and the light integrally interlock with each other.

<Light Emission Control (Second)>

Next, a description will be made of a light emission control (second) of light under which a predetermined image appears with light. As described above, light emission control is performed in accordance with sound, but light emission control is performed so that a predetermined image appears in accordance with motion of the footwear 100.

Figure 7:
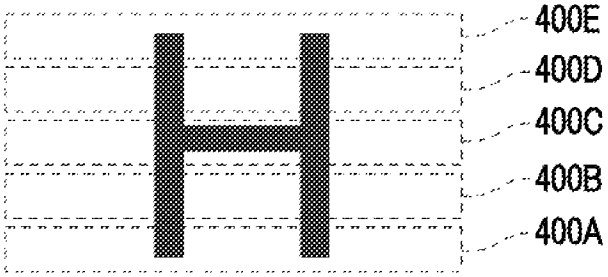
FIGS. 7A and 7B are diagrams for explaining a predetermined image.
Figure 7:
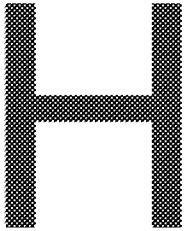

For example, a description will be made of an example in which "H" appears as a predetermined image through light emission control. FIGS. 7A and 7B are diagrams for explaining a predetermined image. FIG. 7A is a diagram illustrating an example of the predetermined image. As illustrated in FIG. 7A, the predetermined image is assumed to be "H".

FIG. 7B is a diagram illustrating an example in which the predetermined image is divided into a plurality of images. As illustrated in FIG. 7B, the predetermined image "H" is divided so as to appear by an afterimage of light. In the example illustrated in FIG. 7B, the predetermined image is divided into five images (400A to 400E) in the vertical direction (the Z direction illustrated in FIGS. 6A and 6B). The LEDs at positions corresponding to the separate images are caused to emit light in order in accordance with a movement direction of the footwear 100, and thus the predetermined image "H" can be displayed on the space by an afterimage of light.

In this case, in a case where it is detected that the footwear 100 is moved upward, the separate images 400A to 400E of the predetermined image are displayed in this order through light emission. In this case, a contribution ratio of light emission control using sound data may be reduced (for example, 0% to 10%), and thus the predetermined image may be noticeable. Consequently, it is possible to adaptively change a contribution ratio according to motion or the like detected from the sensor data.

The control performed so that the predetermined image appears may be performed by the footwear 100 side, or may be performed by the information processing apparatus 200 side. Hereinafter, a description will be made of an example in which the control is performed by the footwear 100 side.

Figure 8:
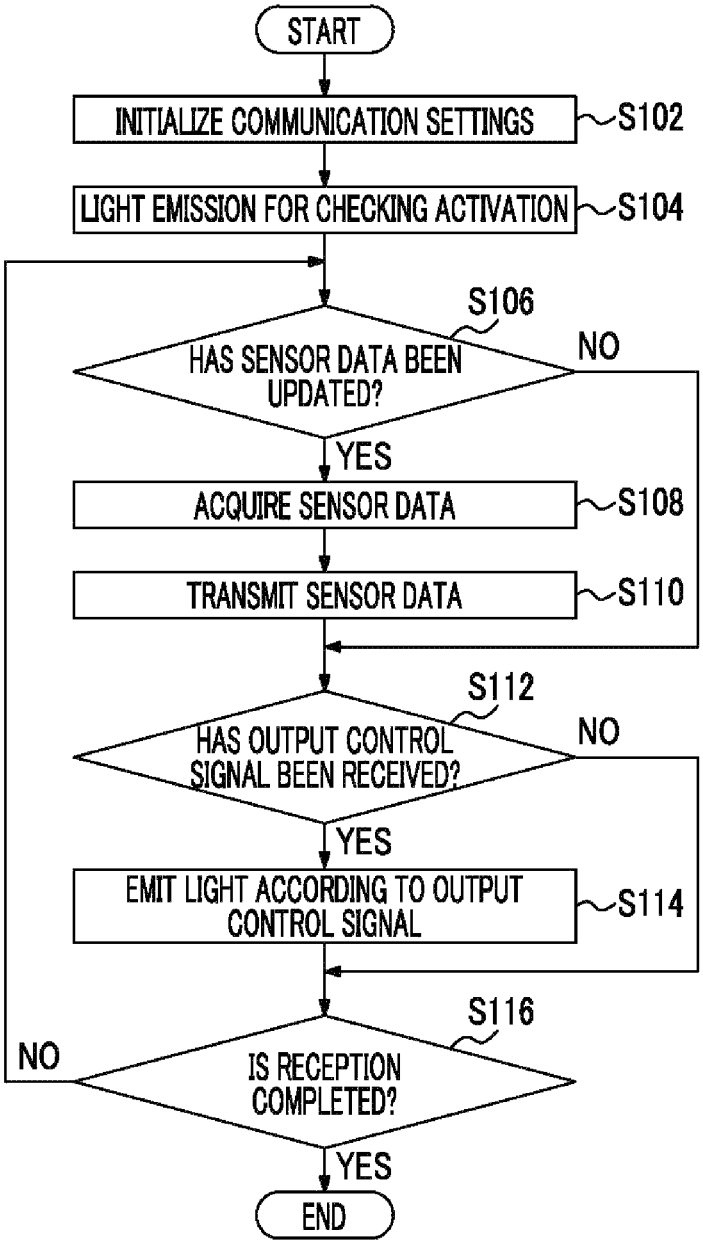
FIG. 8 is a conceptual diagram for explaining that a predetermined image appears.

FIG. 8 is a conceptual diagram for explaining that the predetermined image appears. In FIG. 8, a description will be made of a case where the predetermined image "H" appears by afterimages of light when jumping is performed upward in the Z direction.

At a time point t1, the determination unit 204 detects that jumping is performed upward on the basis of sensor data. For example, if the sensor data indicates that an upward movement distance is equal to or more than a threshold value within a predetermined period in a state in which a horizontal posture is maintained to some degree, the determination unit 204 determines that jumping is performed upwardly. At this time, the conversion unit 208 generates a light emission control signal so that LEDs at positions corresponding to the separate image 400A emit light with a color of the image, and outputs the light emission control signal to the output control unit 206. In a case where the light emission control signal is received from the conversion unit 208, the output control unit 206 prioritizes the signal to an output control signal acquired by the acquisition unit 202 so as to perform light emission control.

At a time point t2, the conversion unit 208 generates a light emission control signal so that LEDs at positions corresponding to the separate image 400B emit light with a color of the image, and outputs the light emission control signal to the output control unit 206. The output control unit 206 performs light emission control so that the separate image 400B appears.

At a time point t3, the conversion unit 208 generates a light emission control signal so that LEDs at positions corresponding to the separate image 400C emit light with a color of the image, and outputs the light emission control signal to the output control unit 206. The output control unit 206 performs light emission control so that the separate image 400C appears.

At a time point t4, the conversion unit 208 generates a light emission control signal so that LEDs at positions corresponding to the separate image 400D emit light with a color of the image, and outputs the light emission control signal to the output control unit 206. The output control unit 206 performs light emission control so that the separate image 400D appears.

At a time point t5, the conversion unit 208 generates a light emission control signal so that LEDs at positions corresponding to the separate image 400E emit light with a color of the image, and outputs the light emission control signal to the output control unit 206. The output control unit 206 performs light emission control so that the separate image 400E appears.

Consequently, the light emitting part of the output control unit 206 emits light from the time point t1 to the time point t5, and thus "H" appears on the space by afterimages of the light. The predetermined image is not limited to a letter, and may be a logo, a picture, or the like.

Each interval between the time point t1 to the time point t5 may be set in advance, and may be set according to a movement speed since the movement speed can be specified on the basis of sensor data. The size of a separate image may be determined depending on arrangement of the LEDs of the sole portion. For example, in a case where the LEDs are provided in the Z direction in a stacked manner, the length of a separate image may be increased in the Z direction.

As a technique of making the predetermined image appear on the space, a technique called persistence of vision (POV) may be used. The POV is a technique of displaying an image or a video by turning on and off LEDs at a high speed in accordance with movement or the like of a device. For example, if a user wearing the footwear 100 repeatedly performs jumping, control may be performed so that a predetermined image appears at vertical movement positions of the LEDs of the footwear 100.

As another example of light emission control, an evaluation result based on a difference between model data indicating a dance step model and sensor data may be expressed by a difference between colors of the LEDs, a difference between light emission positions, or the like.

<Operation>

Next, a description will be made of an operation of the output control system 10. Hereinafter, the operation will be described by exemplifying each process in the above-described two light emission controls, and a process in light emission control in which motion of the footwear 100 is evaluated.

<<Light Emission Control Process (First)>>

Figure 9:
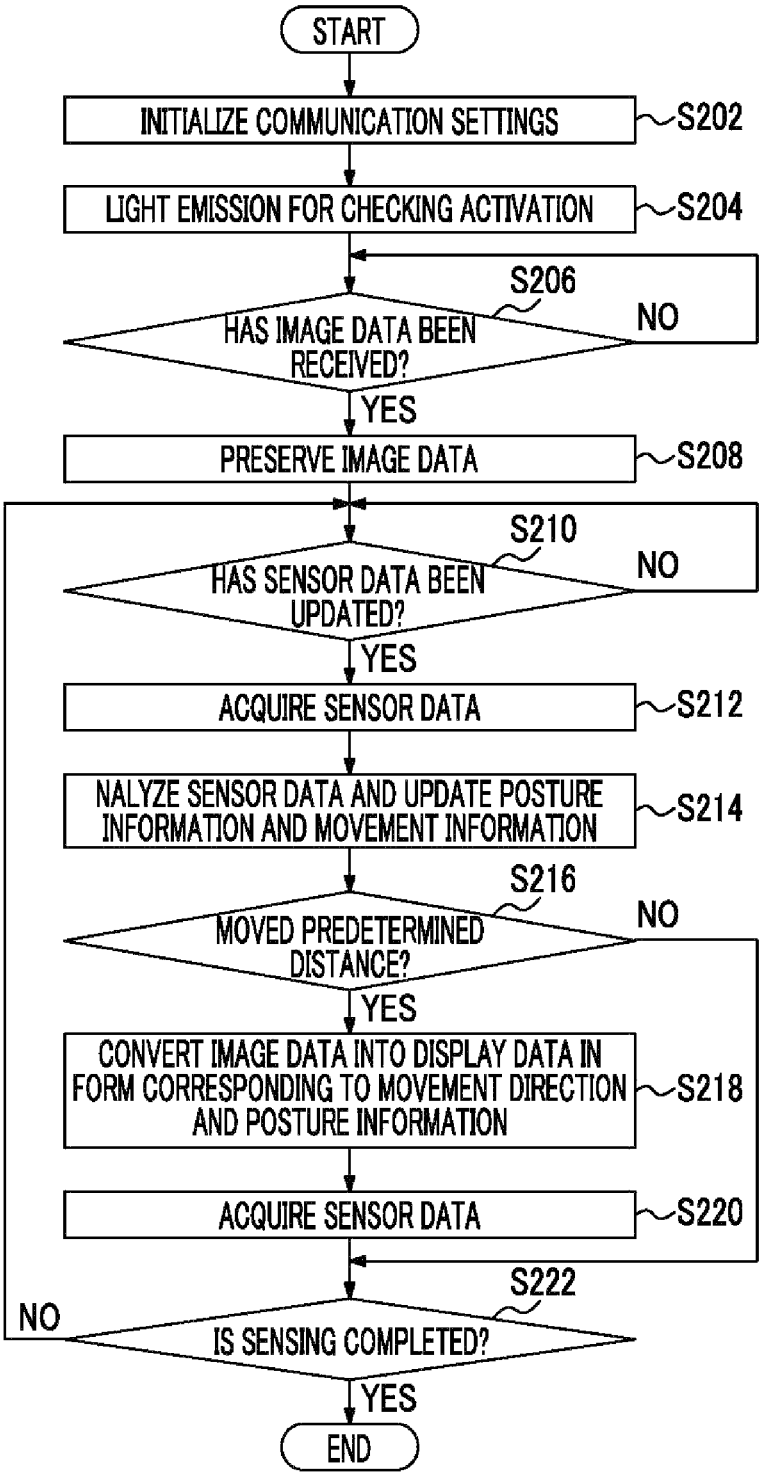
FIG. 9 is a flowchart illustrating an example of a light emission control process (first) in Example.

FIG. 9 is a flowchart illustrating an example of a light emission control process (first) in Example. In step S102 illustrated in FIG. 9, the communication portion 104 initializes communication settings. The initialization includes setting of selecting which apparatus 200 to perform communication with the communication portion 104.

In step S104, the controller 102 controls the output portion 108 to perform output (light emission for checking activation), and a user confirms that the output portion 108 is performing output (light emission).

In step S106, the sensor portion 106 determines whether or not sensor data has been updated. If the sensor data has been updated (YES in step S106), the process proceeds to step S108, and if the sensor data has not been updated (NO in step S106), the process proceeds to step S112.

In step S108, the acquisition unit 202 of the controller 102 acquires the sensor data from the sensor portion 106.

In step S110, the transmission part 142 transmits the sensor data to the information processing apparatus 200.

In step S112, the reception part 144 determines whether or not an output control signal has been received from the information processing apparatus 200. If the output control signal has been received (YES in step S112), the process proceeds to step S114, and if the output control signal has not been received (NO in step S112), the process proceeds to step S116.

In step S114, the output control unit 206 controls light emission of the output portion 108 in response to the output control signal. The output control signal is generated on the basis of sound data and the sensor data.

In step S116, the controller 102 determines whether or not reception of the output control signal is completed. If the reception of the output control signal is completed (YES in step S116), the process is finished, and if the reception of the output control signal is not completed (NO in step S116), the process returns to step S106.

Regarding completion of reception, for example, in a case where an output control signal has not been received for a predetermined period, or in a case where reception is stopped by using a switch, completion of reception is determined.

Through the above-described process, the footwear 100 can adaptively perform output control on the basis of sound and motion.

<<Light Emission Control (second)>>

Figure 10:
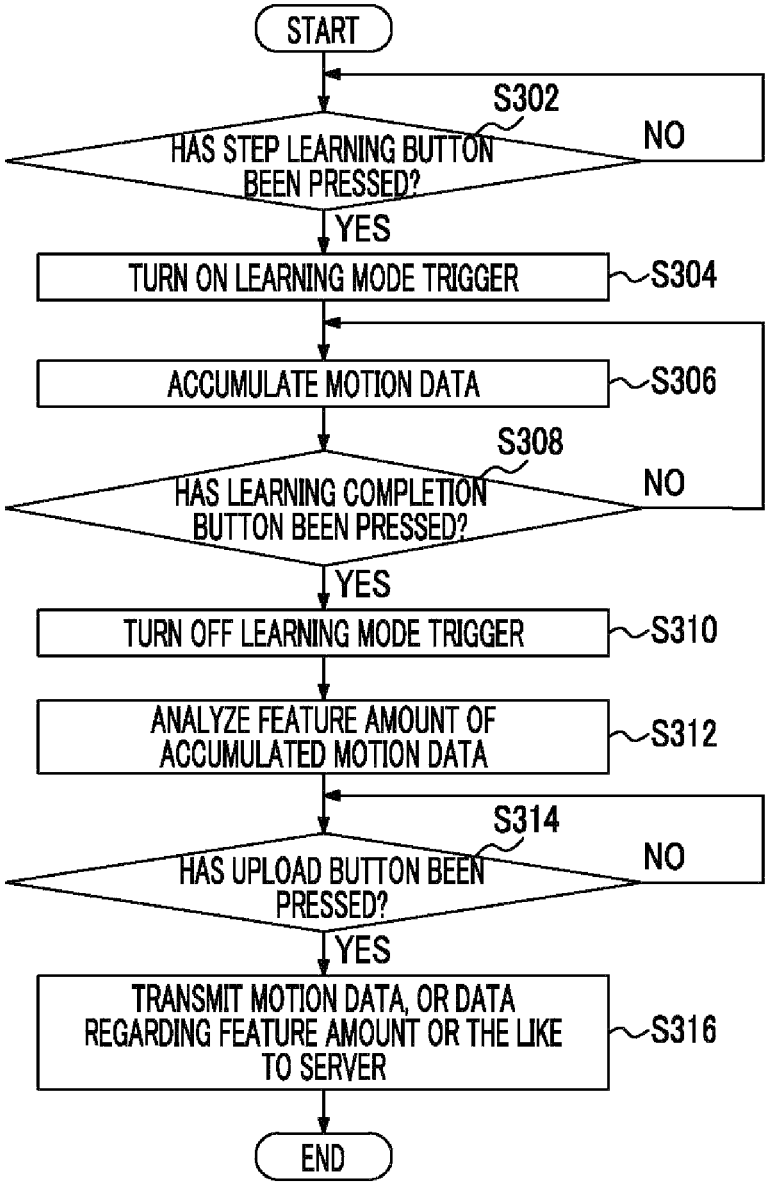
FIG. 10 is a flowchart illustrating an example of a light emission control process (second) in Example.

FIG. 10 is a flowchart illustrating an example of a light emission control process (second) in Example. Steps S202 to S204 illustrated in FIG. 10 are the same as steps S102 to S104 illustrated in FIG. 9, and thus a description thereof will not be repeated.

In step S206, the reception part 144 determines whether or not image data has been received. If the image data has been received (YES in step S206), the process proceeds to step S208, and if the image data has not been received (NO in step S206), the process proceeds to step S206. In this process example, the footwear 100 first acquires the image data.

In step S208, the storage portion 112 stores and preserves the received image data.

In step S210, the sensor portion 106 determines whether or not sensor data has been updated. If the sensor data has been updated (YES in step S210), the process proceeds to step S212, and if the sensor data has not been updated (NO in step S210), the process proceeds to step S210.

In step S212, the acquisition unit 202 of the controller 102 acquires the sensor data from the sensor portion 106.

In step S214, the controller 102 analyzes the sensor data, and updates posture information and movement information.

In step S216, the determination unit 204 determines whether or not the footwear 100 has moved a predetermined distance or more in a predetermined direction. If the condition is satisfied (YES in step S216), the process proceeds to step S218, and if the condition is not satisfied (NO in step S216), the process proceeds to step S222.

In step S218, the conversion unit 208 converts the image data into display data in a form corresponding to the movement direction and the posture information, and generates an output control signal.

In step S220, the output control unit 206 performs light emission control on the basis of the output control signal generated by the conversion unit 208( updates emission color). Herein, it is assumed that the output control unit 206 performs the light emission control until a predetermined image appears on the space (from t1 to t5 in FIG. 8).

In step S222, the controller 102 determines whether or not sensing in the sensor portion 106 is completed. Regarding completion of sensing, in a case where a sensor signal is not updated for a predetermined period, or in a case where sensing is stopped by using a switch, completion of sensing is determined.

Through the above-described process, in a case where the footwear 100 performs predetermined motion, a predetermined image can be made to appear on the space by using afterimages of light. This process may be performed through light emission control based on sensor data, but may be performed if predetermined motion is detected when the light emission control (first) illustrated in FIG. 9 is being performed.

<<Light Emission Control (Third)>>

Prior to description of light emission control for evaluating motion of the footwear 100, a description will be made of a process of uploading model data used as an evaluation reference to the server. The model data is, for example, data sensed in dance steps.

Figure 11:
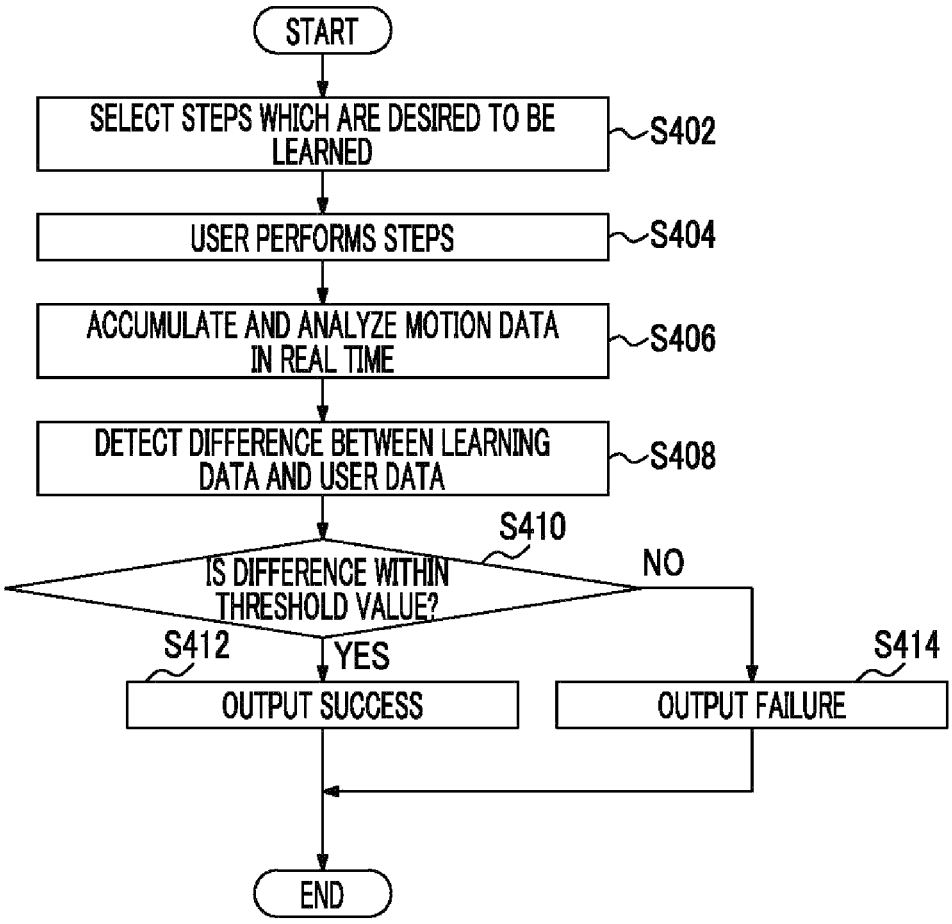
FIG. 11 is a flowchart illustrating an example of a model data upload process in Example.

FIG. 11 is a flowchart illustrating an example of a model data upload process in Example. In step S302 illustrated in FIG. 11, the main controller 40 of the information processing apparatus 200 determines whether or not a step learning button has been pressed. If the step learning button has been pressed (YES in step S302), the process proceeds to step S304, and if the step learning button has not been pressed (NO in step S302), the process returns to step S302. For example, the learning button is a user interface (UI) button displayed on a screen.

In step S304, the main controller 40 turns on a learning mode trigger.

In step S306, the main controller 40 acquires sensor data received from the footwear 100, and accumulates the sensor data in the storage portion 38 as motion data.

In step S308, the main controller 40 determines whether or not a learning completion button has been pressed. If the learning completion button has been pressed (YES in step S308), the process proceeds to step S310, and if the learning completion button has not been pressed (NO in step S308), the process returns to step S306. For example, the learning completion button is a UI button displayed on the screen.

In step S310, the main controller 40 turns off the learning mode trigger.

In step S312, the main controller 40 analyzes a feature amount of the accumulated motion data. Analysis of a feature amount may be performed by using well-known techniques.

In step S314, the main controller 40 determines whether or not an upload button has been pressed. If the upload button has been pressed (YES in step S314), the process proceeds to step S316, and if the upload button has not been pressed (NO in step S314), the process returns to step S314. For example, the upload button is a UI button displayed on the screen.

In step S316, the main controller 40 performs control so that the motion data, or data regarding the feature amount or the like is transmitted to the server. Consequently, model data used as a comparison target is uploaded to the server. The server stores a plurality of model data, and allows the information processing apparatus 200 or the footwear 100 to download the model data.

Figure 12:
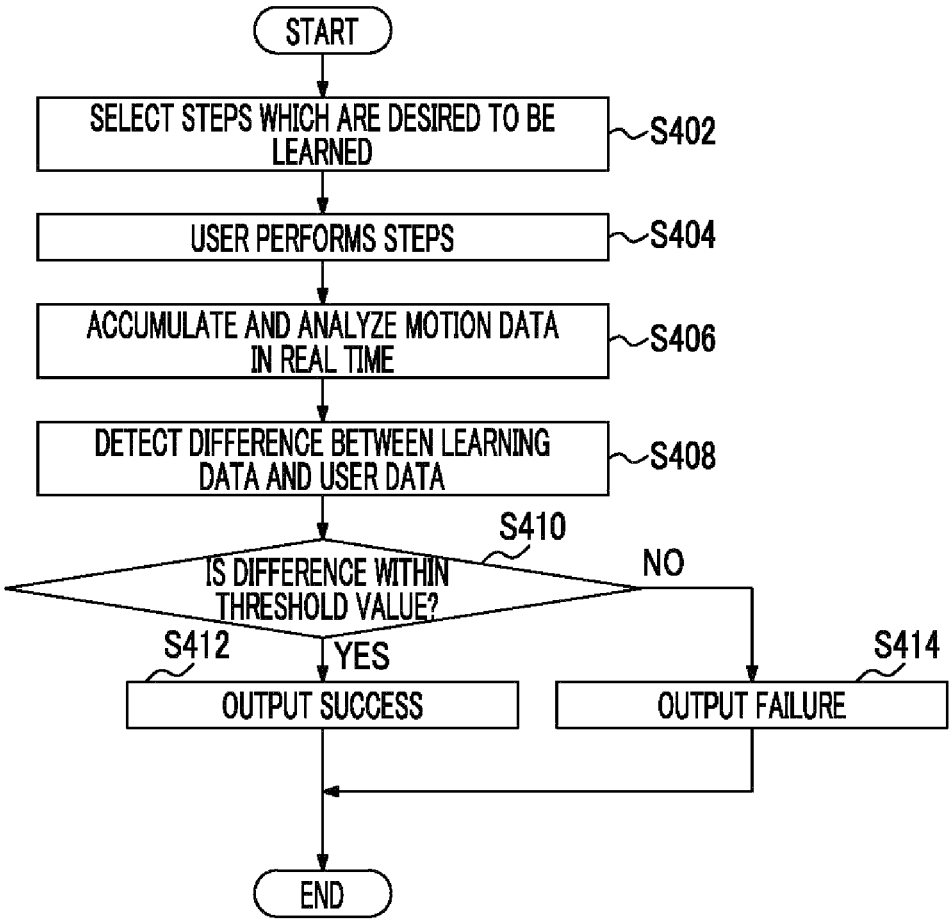
FIG. 12 is a flowchart illustrating an example of a light emission control process (third) in Example.

FIG. 12 is a flowchart illustrating an example of a light emission control process (third) in Example. In the following example, a case where the information processing apparatus 200 evaluates steps will be described as an example.

In step S402 illustrated in FIG. 12, the user who wants to practice steps operates the information processing apparatus 200 to access the server, selects steps which are desired to be learned, and downloads motion data (or feature amount data) as a model to the information processing apparatus 200. The downloaded data will be referred to as learning data.

In step S404, the user wears the footwear 100 and performs the steps selected in step S402.

In step S406, the sensor portion 106 of the footwear 100 transmits sensor data indicating motion of the steps to the information processing apparatus 200. The information processing apparatus 200 accumulates (and analyses)the received sensor data in the storage portion 38 as motion data. The data acquired during practice will be referred to as user data.

In step S408, the main controller 40 detects a difference between the learning data and the user data.

In step S410, the main controller 40 determines whether or not a difference value indicating the difference is within a threshold value. If the difference value is within the threshold value (YES in step S410), the process proceeds to step S412, and if the difference value is greater than the threshold value (NO in step S410), the process proceeds to step S414.

In step S412, the main controller 40 outputs an output control signal indicating success to the footwear 100. Consequently, the footwear 100 can perform output indicating success. For example, the output control unit 206 causes the LEDs to emit light with a first color, displays a circle on the display, or causes a vibrator to perform predetermined vibration.

In step S414, the main controller 40 outputs an output control signal indicating a failure to the footwear 100. Consequently, the footwear 100 can perform main output indicating success. For example, the output control unit 206 causes the LEDs to emit light with the first color, displays a circle on the display, or causes the vibrator to perform predetermined vibration.

In this case, the information processing apparatus 200 may comparatively display the learning data and the user data. Consequently, the user can recognize which motion is favorable and which motion is not favorable, and can thus effectively practice the steps.

The above-described evaluation process may be performed by the controller 102 of the footwear 100 which has downloaded the learning data. Consequently, if the learning data is downloaded to the footwear 100, it is also possible to practice the steps offline.

Through the above process, the user wearing the footwear 100 can practice predetermined motion and can understand an appropriate evaluation result of the practiced motion.

The respective processing steps included in the flows of the processes described in FIGS. 9 to 12 may be arbitrarily changed in their execution order or may be executed in parallel within the scope without causing contradiction in the processing content, and other steps may be added between the processing steps. A step described as a single step for convenience may be divided into a plurality of steps and be executed, and, on the other hand, a step which is divided into and described as a plurality of steps described for convenience may be regarded as a single step.

Modification Examples

As mentioned above, a plurality of embodiments of the technique disclosed in the present application have been described, but the technique disclosed in the present application is not limited thereto.

For example, the main controller 40 of the information processing apparatus 200 generates or selects image data based on a series of motion data and sound data of the footwear 100 of the user, and updates the display content of the LEDs provided in the footwear 100 as the output portion 108 in real time. In this case, the LEDs function as a display having some vertical and horizontal widths. For example, when motion data indicates predetermined motion, a first image with a size which can be displayed is displayed on the display, and, when sound data indicates predetermined sound, a second image with a size which can be displayed is displayed on the display.

The output portion 108 may be a display of an external computer, a video may be displayed on the display, sound may be reproduced by an external speaker, or haptic output or the like may be performed by using a vibration module.

A device such as a piezoelectric element may be provided in an insole of the footwear 100. Consequently, the footwear 100 can detect heel pressing, and can control output of the output portion 108 according to the heel pressing.

The sensor portion 106 may be a ten-axis sensor or the like in which an altimeter is included in the nine-axis sensor. The sensor portion 106 may include a load sensor. Consequently, it is possible to control output of the output portion 108 according to an altitude or a load.

A vibrating element may be provided inside an insole or an instep of the footwear 100. Consequently, it is possible to send a predetermined message to a user with vibration.

The output control system 10 may simultaneously control a plurality of apparatuses. For example, a plurality of pieces of footwear 100 may be simultaneously controlled by using wireless communication. Consequently, it is possible to synchronize emission colors of all pieces of the footwear 100 in a hall with each other by transmitting a light emission pattern (output control signal) from a single information processing apparatus 200.

Acoustic analysis may not only be performed by the information processing apparatus 200 but may also be performed by the controller 102 of the footwear 100. Consequently, the footwear 100 can automatically generate a light emission pattern (output control signal) in accordance with ambient music.

The output control system 10 may generate music. For example, the information processing apparatus 200 or the controller 102 may analyze motion data of the footwear 100, and may generate sound or music matching a movement direction, a movement speed, or the like in real time. The output portion 108 may reproduce specific sound sample data on the basis of gesture recognition using sensor data. For example, the output control system 10 may perform control so that drum sound is reproduced if a heel is pressed down.

The output control system 10 can share data regarding a musical performance in which predetermined sound is associated with predetermined footwear 100, in the server on the Internet via an external apparatus (information processing apparatus 200). Consequently, another user can download the data of the user and can play music with the footwear 100 thereof.

The output control system 10 may share an LED animation, an image drawn by an afterimage, or video data in the server on the Internet via an external apparatus (information processing apparatus 200). Consequently, another user can download the data of the user and can display the data with the footwear 100 thereof.

The output control system 10 may analyze motion detected by the footwear 100. If a nine-axis sensor or the like is used as the sensor portion 106, it is possible to appropriately sense a posture, a movement speed, and a movement distance of the footwear 100 and thus to display an analysis result of such motion on the display in real time.

The footwear 100 of the output control system 10 may be used a controller. For example, gesture of a foot mounted with the footwear 100 is registered in the footwear 100 or the like in advance, and thus the footwear can be used as a wireless controller of another computer. Specifically, lighting of a room may be operated by rotating a right toe.

The output control system 10 may analogize a user's physical features by analyzing sensor data detected by the sensor portion 106 of the footwear 100. Consequently, it is possible to install an application giving advice on an exercise or a method of improving a user's form based on the user's physical features.

In the output control system 10, a global positioning system (GPS) module may be provided in the footwear 100. Consequently, it is possible to perform an operation or the like of indicating a specific location through light emission when entering the specific location by detecting the present location, or it is possible to guide a route by using light emission or vibration by detecting the present direction in combination with a geomagnetism sensor.

A vibrating element may be provided in the footwear 100, and a musical rhythm may be transmitted to a user by causing the vibrating element to vibrate in predetermined rhythm. Alternatively, the footwear 100 may transmit a specific message such as Morse code through vibration of the vibrating element.

Utilization may occur in video output or effect, such as moving CG of the footwear displayed on the display according to sensor data detected by the sensor portion 106 provided in the footwear 100.

The output control system 10 may be used as an acoustic processing apparatus of currently reproduced music. For example, a specific movement amount may be used as an effect amount by using the sensor portion 106 provided in the footwear 100, and thus a movement amount and a volume for a predetermined period are synchronized with each other. Specifically, if a dancer wearing the footwear 100 rotates the feet, and the number of rotations increases, control may be performed so that a volume of music increases.

The present invention is applicable to not only the footwear 100 but also a wearable device (for example, a wristwatch or glasses) which is mounted at a position where a user's motion is desired to be detected. The sensor portion 106 may not be provided inside the footwear 100 or the wearable device but may be mounted at a position where motion is desired to be detected as an external device.

The program of the present invention may be downloaded through various recording media, for example, an optical disc such as a CD-ROM, a magnetic disk, and a semiconductor memory, or via a communication network, so as to be installed in or loaded to a computer.

In the present specification or the like, the "unit" or the "portion" does not only indicate a physical configuration but also includes a case where a function of the configuration is realized by software. A function of a single configuration may be realized two or more physical configurations, and functions of two or more configurations may be realized by a single physical configuration. The "system" includes a system which is constituted of an information processing apparatus and the like and provides a specific function to a user. For example, the system is constituted of a server apparatus, a cloud computing type apparatus, an application service provider (ASP), or a client server model apparatus, but is not limited thereto.

Embodiment 2

In Embodiment 2, a specific structure of the footwear 100 which has not been described in Embodiment 1 will be described, and output control which has not been described in Embodiment 1 will be described.

Figure 13:
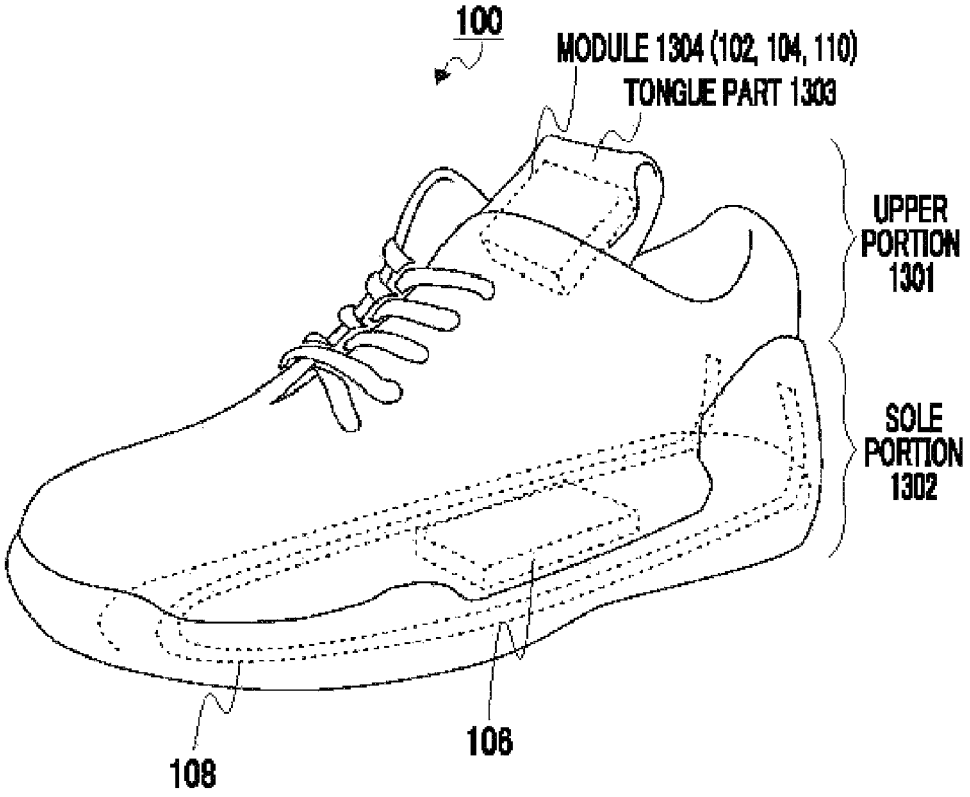
FIGS. 13A and 13B are exterior views illustrating an exterior of footwear related to Example.
Figure 13:
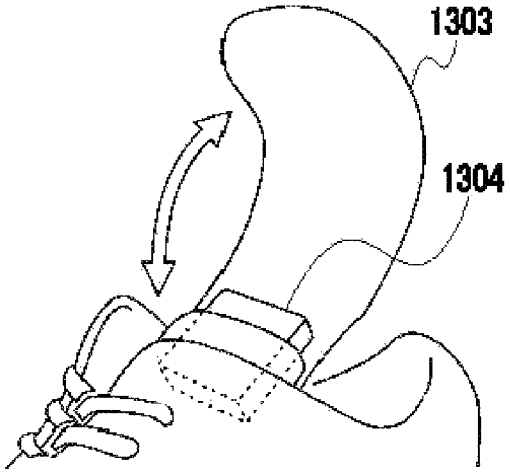

FIG. 13A is an exterior view illustrating a configuration of the footwear 100. As illustrated in FIG. 13A, the footwear 100 is configured to include an upper portion 1301 which is an upper surface side of the footwear 100 and covers and fixes the instep of a user wearing the footwear 100, and a sole portion 1302 which is a bottom surface side of the footwear 100, and has a function of absorbing shocks. The upper portion 1301 is provided with a tongue part 1303 for protecting the user's instep. A module 1304 including the controller 102, the communication portion 104, and the power source portion 110 is provided in the tongue part 1303. As illustrated in FIG. 13B, the tongue part 1303 is opened, and thus the module 1304 which is inserted into a pocket provided in the tongue part 1303 can be exposed. Although not illustrated, a terminal (for example, a USB terminal) for being supplied with power is provided in the module 1304, as illustrated in FIG. 13B, the tongue part 1303 is opened, the terminal is connected to an external power source, and thus power is supplied so that the power source portion 110 can be charged. The communication portion 104 may perform communication based on, for example, a Bluetooth low energy standard so that power consumption caused by the communication may be minimized.

In the footwear 100, the sole portion 1302 includes the output portion 108 and the sensor portion 106. The sensor portion 106 is provided inside a shank which is the inside of the sole portion 1302 and is located at a position corresponding to the arc of a user's foot. Although not illustrated, the sensor portion 106, which is connected to the module 1304 through the inside of the footwear 100, is operated by being supplied with power from the power source portion 110 of the module 1304 and transmits sensor data to the module 1304. Consequently, the sensor data sensed by the sensor portion 106 is transmitted to the external information processing apparatus 200 via the communication portion 104.

Figure 14:
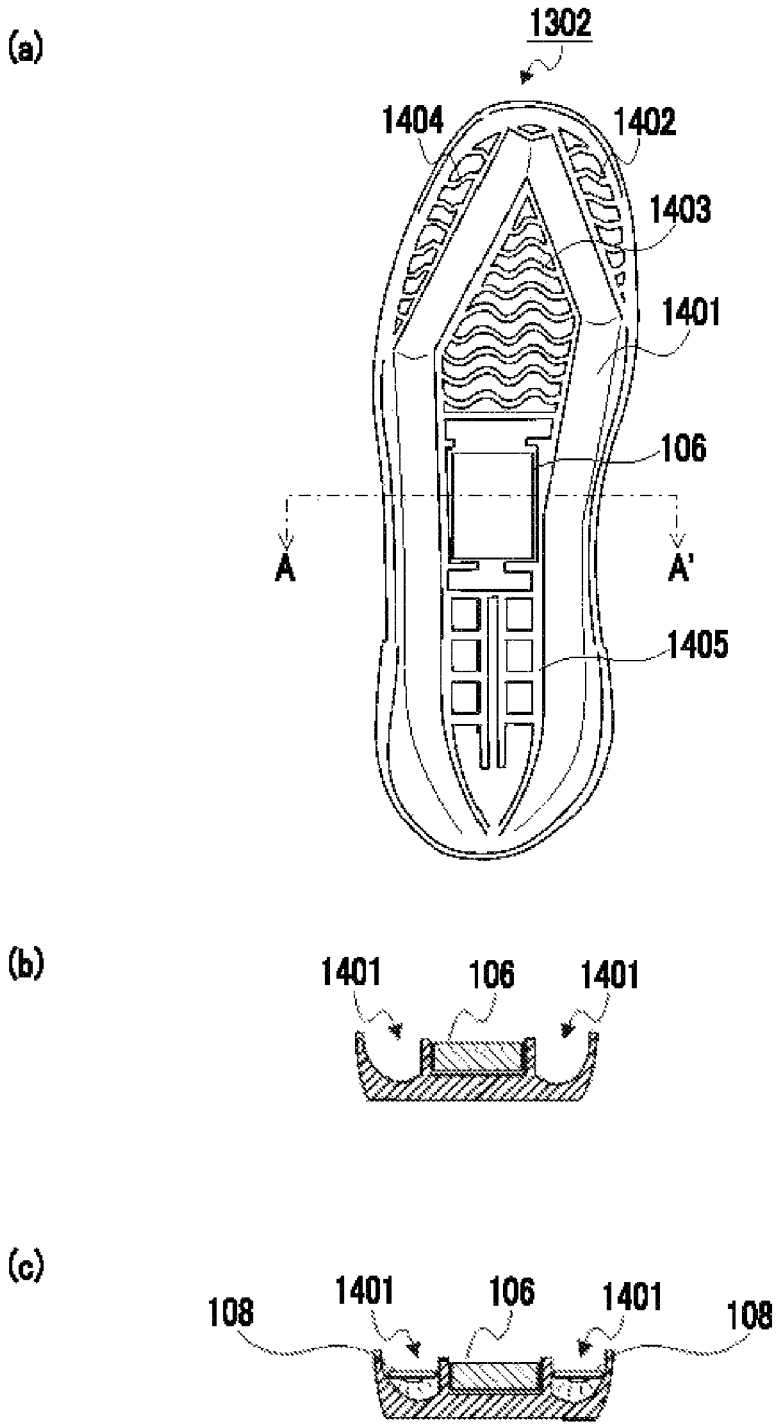
FIG. 14A is a plan view of a sole portion of the footwear related to Example.
FIG. 14B is a sectional view taken along the line XIVB-XIVB.
FIG. 14C is a sectional view taken along the line A-A', and is a diagram illustrating a state in which a light emitting part is mounted.

FIG. 14A is a plan view of the sole portion 1302, and FIG. 14B is a sectional view in which the sole portion 1302 in FIG. 14A is cut along the line XIV-XIV. As illustrated in FIG. 14A, the sole portion 1302 includes a recess 1401 for mounting the output portion 108. The recess 1401 is provided at an outer circumferential part of the sole portion 1302 along an outer edge thereof inside the sole portion 1302. The recess 1401 is recessed in order to mount the output portion 108, and an LED tape is provided at the recess 1401 as the output portion 108. As illustrated in FIG. 14A, the sensor portion 106 is provided at a location where the recess 1401 is not provided and which opposes the arc of the user's foot inside the sole portion 1302. The location is a position which is called a shank in the structure of the footwear 100. Ribs 1402 to 1405 for absorbing shocks are provided at positions where the recess 1401 and the sensor portion 106 are not provided in the sole portion 1302. The ribs 1402 and 1403 are provided further toward the outer circumferential side than the recess 1401 on a toe side of the user in the sole portion 1302. Consequently, shocks applied to the front end of the footwear 100 can be absorbed in the footwear 100, and thus it is possible to reduce a possibility that the output portion 108 provided at the recess 1401 may fail and also to reduce a burden applied to the user's foot. Similarly, the ribs 1404 and 1405 are located at the center of the footwear 100 and can absorb shocks applied to the footwear, and thus it is possible to reduce a possibility that the output portion 108 provided at the recess 1401 may fail and also to reduce a burden applied to the user's foot.

FIG. 14C is a sectional view of the sole portion 1302, and illustrates a state in which the LED tape as the output portion 108 is mounted. As illustrated in FIG. 14C, the output portion 108 is mounted so that a light emitting surface thereof is directed toward the bottom surface side of the footwear 100. In other words, the bottom surface of the footwear 100 emits light. The present inventor has found that, if the LED tape is provided along the side surface of the sole portion 1302 so that a side surface side emits light, a damage ratio of the LED tape, especially, the flexibility thereof at tiptoe increases, and thus the damage ratio increases. For this reason, as a result of looking for a solution to mounting of the LED tape for further reducing a damage ratio, as illustrated in FIG. 14C, the present inventor has conceived of a configuration in which the LED tape is mounted so that the light emitting surface thereof is directed toward the bottom surface side of the sole portion 1302. The sole portion 1302 is made of a transparent or translucent resin with high shock-absorbability, and thus transmits light emitted from the LED tape therethrough, and, as a result, it is possible to provide the footwear 100 whose bottom surface emits light.

Figure 15:
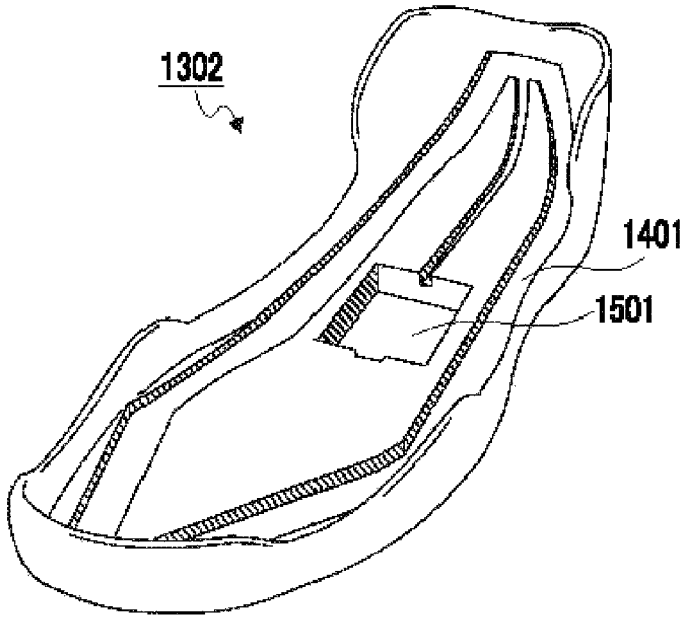
FIG. 15A is a perspective view of the sole portion.
FIG. 15B is a perspective view of the sole portion, and is a perspective view illustrating a state in which the light emitting part and a sensor portion 106 are mounted.
Figure 15:
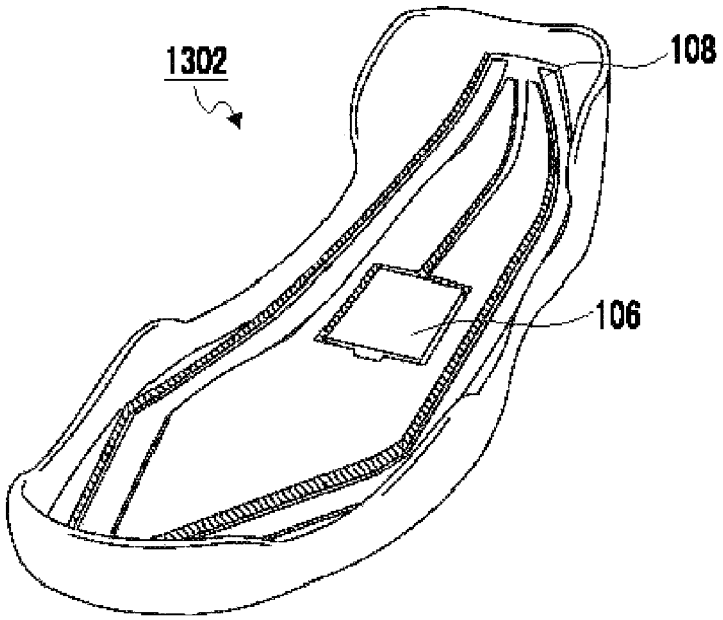

FIGS. 15A and 15B are perspective views of the sole portion 1302 provided for better understanding of a structure of the sole portion 1302. FIG. 15A is a perspective view illustrating a state in which the sensor portion 106 and the output portion 108 are not mounted in the sole portion 1302, and FIG. 15B is a perspective view illustrating a state in which the output portion 108 and the sensor portion 106 are mounted in the sole portion 1302. As is clear from comparison between FIGS. 15A and 15B, the output portion 108 which is the LED tape is mounted at the recess 1401, and is provided at the outer circumferential part of the bottom surface of the sole portion 1302. The sensor portion 106 is provided at a depression 1501 formed in the sole portion 1302. Since the depression 1501 substantially has the same outer diameter as that of the sensor portion 106, when the sensor portion 106 is mounted at the depression 1501, moving thereof can be prevented as much as possible, and detection of motion in the sensor portion 106 can also be performed regarding detection of motion of only the footwear 100. In a case where the sensor portion 106 is provided in the module 1304 of the tongue part 1303 of the footwear 100, sensing accuracy may be reduced, and thus the sensor portion is provided in the sole portion 1302 so that more stable sensing can be performed.

The structures illustrated in FIGS. 13A to 15B are provided, and thus it is possible to accurately detect motion of the footwear 100 and to provide the footwear 100 capable of performing stable light emission control.

Embodiment 3

In Embodiment 3, a description will be made of sound output control for outputting sound corresponding to motion of the footwear 100. In the above Embodiment 1, a description has been made of an example in which light emission control suitable for ambient sound is performed, but, in Embodiment 3, a description will be made of a method of outputting sound suitable for motion of a user wearing the footwear 100, that is, motion of the footwear 100.

Figure 16:
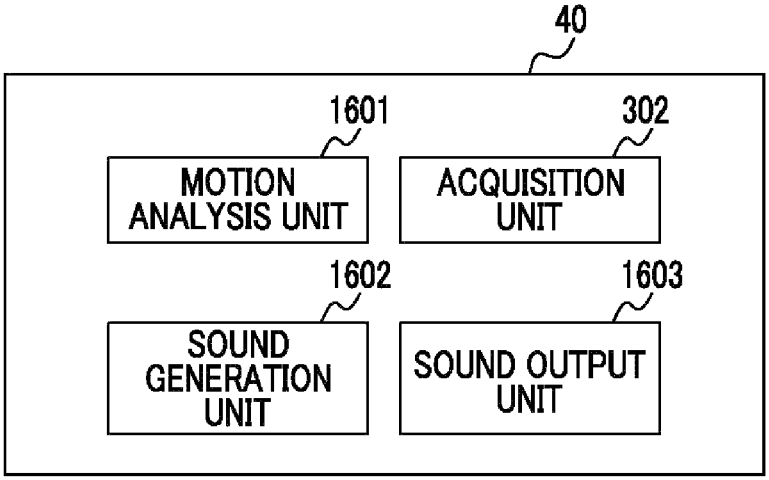
FIG. 16 is a diagram illustrating an example of a function of a main controller of an information processing apparatus related to Example.

FIG. 16 is a diagram illustrating an example of a function of the main controller 40 of the information processing apparatus 200 according to Embodiment 3. A configuration of the information processing apparatus 200 is the same as that illustrated in FIG. 3 of Embodiment 1. The main controller 40 illustrated in FIG. 16 executes a predetermined program and thus functions as at least an acquisition unit 302, a motion analysis unit 1601, a sound generation unit 1602, and a sound output unit 1603.

The acquisition unit 302 has the function described in the above Embodiment 1, and also acquires a sound file table 1700 and an output sound table 1710 stored in the storage portion 38 from the storage portion 38 and transmits the tables to the sound generation unit 1602. Hereinafter, the sound file table 1700 and the output sound table 1710 will be described. The acquisition unit 302 acquires a sound file or actual data of a sound source stored in the storage portion 38. The acquisition unit 302 acquires user setting information regarding the sound output control from the storage portion 38.

Here, the user setting information regarding the sound output control is information regarding settings regarding a method of controlling sound which is output according to motion of the footwear 100, and is set in advance in the information processing apparatus 200 from the user by using the touch panel 14. The settings are stored in the storage portion 38. Here, sound output control methods which can be set as the user setting information include at least three methods. First, a movement amount of the footwear 100 is analyzed, and sound is combined and output according to motion thereof; second, in a case where motion of the footwear 100 matches a specific pattern, predefined specific sound is output; and third, both of the first and second methods are performed.

FIG. 17A is a data conceptual diagram illustrating a data configuration example of the sound file table 1700 stored in the storage portion 38. As illustrated in FIG. 17A, the sound file table 1700 is information in which gesture data 1701 is correlated with a sound file 1702.

The gesture data 1701 is information indicating a motion pattern defining motion of the footwear 100, and is information indicating a temporal change of a movement amount or acceleration. More specifically, the gesture data 1701 is information indicating a temporal change of a movement amount or acceleration related to each of an X axis direction, a Y axis direction, and a Z axis direction.

The sound file 1702 is correlated with the gesture data 1701, and is information for specifying sound file which is output when matching a pattern of sensor data analyzed by the motion analysis unit 1601.

In a case where the analyzed motion of the footwear 100 has a correlation of a predetermined level or higher with the gesture data 1701, sound is output by using a corresponding sound file.

The output sound table 1710 is information in which movement amount data 1711 and a sound parameter 1712 are correlated with each other.

The movement amount data 1711 is information indicating a movement amount and acceleration ( which may be referred to as movement pattern), and is information for not defining a pattern of specific motion but indicating a movement amount and acceleration in each of the X axis direction, the Y axis direction, and the Z axis direction.

The sound parameter 1712 is information which is correlated with the movement amount data 1711 and indicates information regarding sound which is output in a case where information indicated by the movement amount data 1711 is obtained on the basis of sensor data, and is parameter information for defining sound to be output or a change (for example, a change in a musical interval or a change in a sound reproduction speed) applied to the sound to be output.

In a case where motion indicated by the movement amount data 1711 is detected, sound associated with a corresponding sound parameter is output.

Actual data of each sound file shown in the sound file 1702 of the sound file table 1700 is stored in the storage portion 38.

Returning to description of the function of the main controller 40, the motion analysis unit 1601 analyzes motion of the footwear 100 on the basis of the sensor data acquired by the acquisition unit 302. The motion analysis unit 1601 analyzes motion information of the footwear 100 indicated by the sensor data on the basis of the sensor data. Specifically, a temporal change of a movement amount or acceleration of the footwear 100 is specified on the basis of the sensor data. The motion analysis unit 1601 transmits the analyzed motion information to the sound generation unit 1602.

The sound generation unit 1602 generates sound to be output by referring to the motion information transmitted from the motion analysis unit 1601, and the sound file table 1700 and the output sound file output sound file 1710 transmitted from the acquisition unit 302, according to the user setting information regarding the sound output control acquired by the acquisition unit 302. The sound generation unit 1602 transmits the generated sound to the sound output unit 1603. Details of a method of generating sound will be described later.

The sound output unit 1603 outputs, from the speaker 16 of the information processing apparatus 200, the sound transmitted from the sound generation unit 1602. The above description relates to the main controller 40 according to Embodiment 3.

Figure 18:
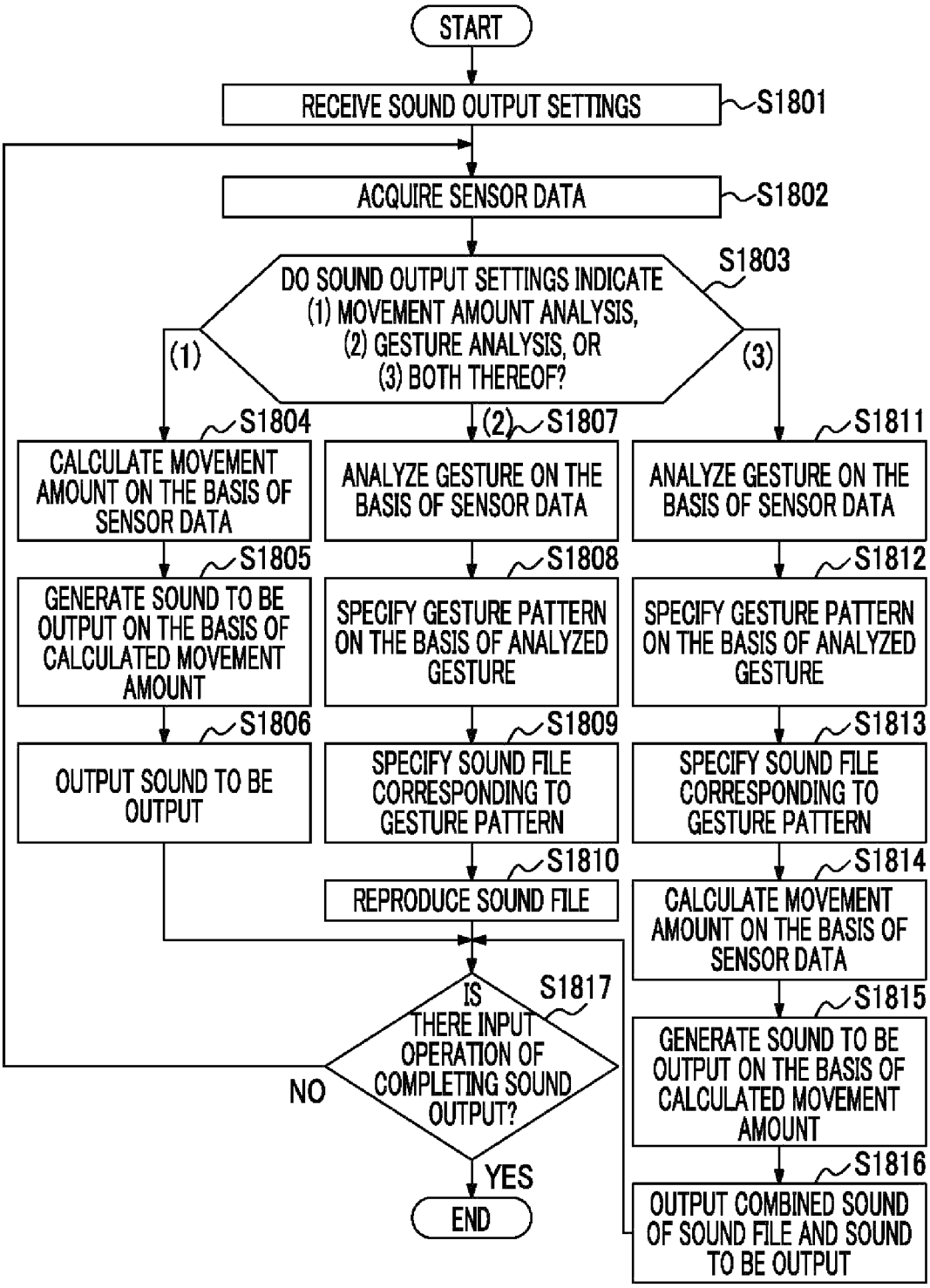
FIG. 18 is a flowchart illustrating sound output control performed by the information processing apparatus related to the footwear of Example.

FIG. 18 is a flowchart illustrating an operation of the information processing apparatus 200 according to Embodiment 3. In step S1801, the touch panel 14 of the information processing apparatus 200 receives user setting information regarding sound output control from the user (sound output settings). The main controller 40 records the user setting information in the storage portion 38.

In step S1802, the acquisition unit 302 acquires sensor data from the sensor portion 106 of the footwear 100. The sensor data is data which is sensed for a predetermined period (for example, for one second).

In step S1803, the acquisition unit 302 acquires the user setting information regarding the sound output control set in step S1801 from the storage portion 38, and the main controller 40 determines a sound output control method.

In a case where the user setting information indicates movement amount analysis ((1) in step S1803), the process proceeds to step S1804. In a case where the user setting information indicates gesture analysis ((2) in step S1803), the process proceeds to step S1807. In a case where the user setting information indicates execution of both of the movement amount analysis and the gesture analysis ((3) in step S1803), the process proceeds to step S1811.

In step S1804, the motion analysis unit 1601 calculates a movement amount on the basis of the sensor data. The motion analysis unit 1601 transmits the calculated movement amount to the sound generation unit 1602.

In step S1805, the acquisition unit 302 reads the output sound table 1710 from the storage portion 38. The sound generation unit 1602 specifies the movement amount data 1711 which is highly correlated with the transmitted movement amount, and specifies a corresponding sound parameter 1712. The sound generation unit 1602 generates sound (sound indicated by the sound parameter 1712, or sound in which a parameter indicated by the sound parameter 1712 is changed in sound which is output hitherto) to be output on the basis of the specified sound parameter 1712. The sound generation unit 1602 transmits the generated sound to the sound output unit 1603.

In step S1806, the sound output unit 1603 outputs the sound transmitted from the sound generation unit 1602 from the speaker 16, and proceeds to a process in step S1817.

On the other hand, in a case where the user setting information indicates only the gesture analysis, in step S1807, the motion analysis unit 1601 analyzes gesture on the basis of the sensor data.

In step S1808, the acquisition unit 302 reads the sound file table 1700 from the storage portion 38. The motion analysis unit 1601 calculates a correlation value between a temporal change of a movement amount or acceleration indicated by the sensor data and a temporal change of a movement amount or acceleration indicated by the gesture pattern 1701 of the sound file table 1700. A gesture pattern which causes the greatest correlation value to be obtained is specified. The motion analysis unit 1601 transmits the specified gesture pattern to the sound generation unit 1602.

In step S1809, the sound generation unit 1602 specifies a sound file corresponding to the transmitted gesture pattern by using the sound file table 1700. The specified sound file is transmitted to the sound output unit 1603.

In step S1810, the sound output unit 1603 outputs (reproduces) the transmitted sound file from the speaker 16, and proceeds to a process in step S1817.

In a case where the user setting information indicates execution of both of the movement amount analysis and the gesture analysis, in step S1811, the motion analysis unit 1601 first analyzes gesture on the basis of the sensor data.

In step S1812, the acquisition unit 302 reads the sound file table 1700 from the storage portion 38. The motion analysis unit 1601 calculates a correlation value between a temporal change of a movement amount or acceleration indicated by the sensor data and a temporal change of a movement amount or acceleration indicated by the gesture pattern 1701 of the sound file table 1700. A gesture pattern which causes the greatest correlation value to be obtained is specified. The motion analysis unit 1601 transmits the specified gesture pattern to the sound generation unit 1602.

In step S1813, the sound generation unit 1602 specifies a sound file corresponding to the transmitted gesture pattern by using the sound file table 1700.

In step S1814, the motion analysis unit 1601 calculates a movement amount on the basis of the sensor data. The motion analysis unit 1601 transmits the calculated movement amount to the sound generation unit 1602.

In step S1815, the acquisition unit 302 reads the output sound table 1710 from the storage portion 38. The sound generation unit 1602 specifies the movement amount data 1711 which is highly correlated with the transmitted movement amount, and specifies a corresponding sound parameter 1712.

In step S1816, the sound generation unit 1602 generates sound based on the specified sound file and the specified sound parameter. In a case where the sound parameter 1712 indicates specific sound, the sound generation unit 1602 synthesizes a sound file from the sound, and, in a case where the sound parameter 1712 indicates that a parameter of sound is changed, the sound generation unit 1602 applies the change to the sound file so as to generate combined sound. The sound generation unit 1602 transmits the generated combined sound to the sound output unit 1603. The sound output unit 1603 outputs the transmitted combined sound from the speaker 16, and proceeds to a process in step S1817.

In step S1817, the main controller 40 determines whether or not an input operation of completing the sound output control has been received from the user via the touch panel 14. In a case where the input operation has been received (YES in step S1817), the process is finished, and, in a case where the input operation has not been received (NO in step S1817), the process returns to step S1802. The above description relates to sound output control in which sound corresponding to motion of the footwear 100 is output by the information processing apparatus 200 and the footwear 100 according to Embodiment 3.

Appendixes

The footwear 100 related to the present invention has been described according to the embodiments, but configurations included as the spirit of the present invention are not limited thereto. Other various reference examples will be described.

Figure 19:
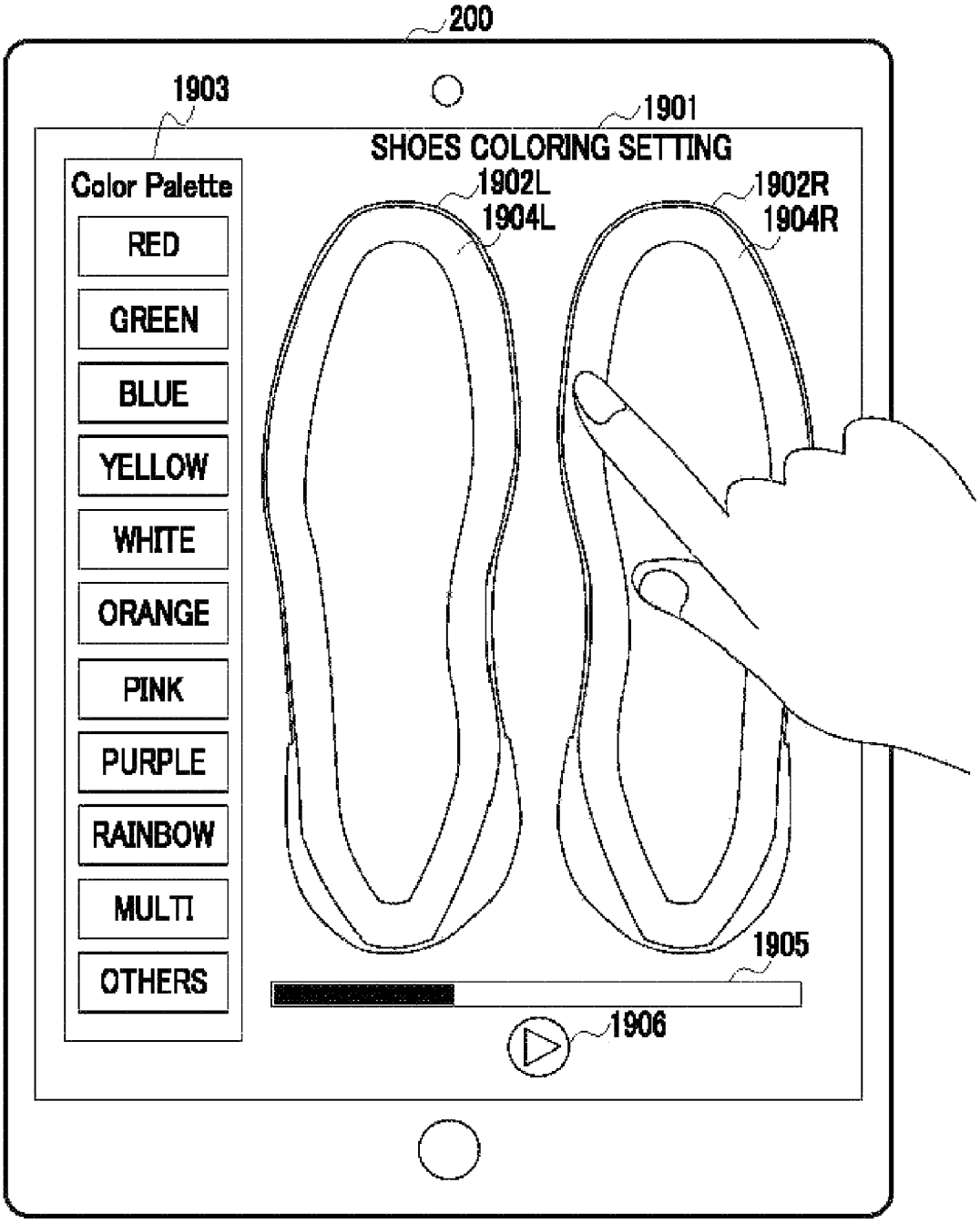
FIG. 19 is a conceptual diagram illustrating an example of a user interface in a light emission control process for the footwear related to Example.

(1) A user may designate any light emission control for the footwear 100 by using the information processing apparatus 200 according to the embodiments. FIG. 19 illustrates an interface screen for performing light emission control on the footwear 100 through a user's designation by using the information processing apparatus 200 according to Embodiment 4. As illustrated in FIG. 19, an interface screen 1901 includes an exterior 1902L of footwear 100 for the left foot, an exterior 1902R of footwear 100 for the right foot, an LED lighting region 1904L in the left foot footwear 100, a color palette 1903 for setting a color with which the LED is lighted, an LED lighting region 1904R in the right foot footwear 100, a time bar 1905 exhibiting time in a light emission pattern in a case where LED lighting control is performed in the predetermined time unit, and a light emission button 1906 for emitting set light.

The lighting regions 1904L and 1904R illustrated in FIG. 19 are touched, and thus a location of an LED which is desired to be lighted can be arbitrarily designated.

An emission color which is desired to be lighted may be designated in the color palette 1903. A plurality of buttons indicating colors which are desired to be emitted are arranged in the color palette 1903, and a corresponding button is touched so that light can be emitted in a color corresponding to the selected button. In the color palette 1903, "RAINBOW" indicates that the LED is lighted in rainbow colors, "MULTI" indicates that the LED is lighted in a plurality of colors, and "OTHERS" is a selection button used in a case where other colors are selected.

The time bar 1905 is used in a case where light emission control is changed in a time series, and a time and a light emission pattern (a light emission location, an emission color, and a light emission method) at that time are designated and are stored in the storage portion 38. The light emission button 1906 is touched, and thus the footwear 100 can emit light in the designated light emission pattern. A user can designate any light emission by using such an interface, and thus it is possible to improve convenience of the footwear 100.

The interface may be realized by the main controller 40 executing a GUI program which can perform the above-described process.

(2) In the above Embodiment 3, in a case where the gesture analysis is performed, a gesture pattern having the greatest correlation value is specified, but the sound generation unit 1602 of the main controller 40 may determine that a gesture pattern corresponding to detected motion information is not registered in a case where the correlation value does not exceed a predetermined threshold value. In this case, there may be a configuration in which a sound file is not specified, and sound based on a sound file is not output.

(3) In the above Embodiment 3, the sound output control is performed by the information processing apparatus 200, but may be performed by the footwear 100 which includes a processor performing the sound output control and a speaker.

(4) In the above Embodiment 3, a user may designate a sound file corresponding to a gesture pattern.

(5) The respective functions of the main controller 40 or the controller 102 described in the embodiments may be realized by a dedicated circuit which realizes the same functions as the functions. The dedicated circuit may have a configuration in which a plurality of functions of the functional units of the main controller 40 or the controller 102 are executed, and a configuration in which a function of a single functional unit is realized by a plurality of circuits.

The invention claimed is:

1. Footwear comprising:

a sensor portion that detects motion of the footwear;

a transmission portion that transmits sensor data detected by the sensor portion to an external apparatus;

a reception portion that receives an output control signal from the external device, the output control signal is generated based on an association between sound data stored in the external apparatus and the sensor data and an output parameter defining output; and an output portion that performs output sound or light based on the output control signal, wherein the output control signal is generated at the external device based at least in part on user input indicative of a contribution ratio embodied as a changeable value, and wherein the contribution ratio defines a ratio between the sound data and the sensor data for use by the output portion when generating light or sound output, and wherein each of the sound data and the sensor data contributes to the output control signal.

* * * * *